United States Patent [19]

Furuta et al.

[11] Patent Number: 4,742,371

[45] Date of Patent: May 3, 1988

[54] OPTICAL SYSTEM FOR COLOR COPIER

[75] Inventors: Hideya Furuta; Yutaka Koizumi, both of Yokohama; Kazusige Taguchi, Ageo; Yoshihiro Sakai, Kawasaki, all of Japan

[73] Assignee: Ricoh Company, Ltd., Tokyo, Japan

[21] Appl. No.: 44,742

[22] Filed: May 1, 1987

[30] Foreign Application Priority Data

| | | | |
|---|---|---|---|
| May 1, 1986 | [JP] | Japan | 61-101638 |
| May 1, 1986 | [JP] | Japan | 61-101639 |
| May 15, 1986 | [JP] | Japan | 61-111238 |
| May 18, 1986 | [JP] | Japan | 61-113031 |
| May 18, 1986 | [JP] | Japan | 61-113032 |
| May 19, 1986 | [JP] | Japan | 61-112474 |
| May 19, 1986 | [JP] | Japan | 61-112475 |
| Aug. 12, 1986 | [JP] | Japan | 61-189204 |

[51] Int. Cl.[4] ..... G03G 15/01

[52] U.S. Cl. ..... 355/4; 355/32

[58] Field of Search ..... 355/4, 32, 35–38, 355/3 R; 358/75; 346/157

[56] References Cited

U.S. PATENT DOCUMENTS

| | | | |
|---|---|---|---|
| 3,667,841 | 6/1972 | Ross | 355/32 X |
| 4,371,253 | 2/1983 | Day et al. | 355/4 |
| 4,577,954 | 3/1986 | Kajiwara | 355/4 |
| 4,615,607 | 10/1986 | Yanagawa et al. | 355/4 X |

FOREIGN PATENT DOCUMENTS

| | | | |
|---|---|---|---|
| 3217461 | 6/1982 | Fed. Rep. of Germany . | |
| 0073064 | 6/1980 | Japan | 355/4 |
| 0154856 | 9/1983 | Japan | 355/4 |
| 0207021 | 12/1983 | Japan | 355/4 |

*Primary Examiner*—R. L. Moses

*Attorney, Agent, or Firm*—Oblon, Fisher, Spivak, McClelland & Maier

[57] ABSTRACT

An optical system for a color copier in which light images of blue, green and red produced by color separation are formed one on each of three photoconductive elements, then developed by toner of associated colors, and then transferred one upon another onto a paper. A first mirror is disposed in an optical path to which light representative of an image of an original document is led through an image-forming lens and a mirror group. Light reflected by the first mirror is focused onto a first photoconductive element. Light transmitted through the first mirror is split by a second mirror which is located in a position for intercepting a part of the width of a slit for exposure. Light reflected by the second mirror is focused onto a second photoconductive element. Further, light outside the range of the second mirror is reflected by a third mirror to be focused onto a third photoconductive element. The first mirror has a spectral characteristic which reflects light of one of three colors, i.e., blue, green and red while transmitting light of the other two colors. All of the first to third mirrors comprise total reflection mirrors, or only the first mirror comprises a half-mirror. A reflection from the first mirror is of a particular color to which the photoconductive elements show the smallest amount of reaction. Light of wavelengths outside a predetermined range of each color which is to be reflected by any of the mirrors is cut by using the reflection characteristic of the mirror (as well as a transmission characteristic in the case of the half-mirror) and the transmission characteristics of a filter which is associated with the mirror.

21 Claims, 24 Drawing Sheets

$E_\lambda = S_\lambda \cdot H_\lambda \cdot F_\lambda \cdot T_\lambda$

Fig. 21A CLOCK GENERATOR 164

Fig. 21B NON-INVERTING AMP 156

Fig. 21C INVERTING AMP 160

Fig. 21D ANALOG SWITCH 166

OPTICAL SYSTEM FOR COLOR COPIER

BACKGROUND OF THE INVENTION

The present invention relates to an optical system installed in a color copier of the type having a plurality of photoconductive elements, particularly at lest three photoconductive elements, in order to split its optical path.

In the art of color copiers, two different types of optics are known: one in which two half-mirrors and a single total reflection mirror are positioned in an optical path, along which an imagewise reflection from a document is propagated, in an angular position of 45 degrees each so as to split the optical path into three, the amounts of light of different colors being balanced by the half-mirrors, color separating filters, and neutral densitys (ND) filter; and one in which colored half-mirrors are used to effect the division of an optical path and color separation at the same time. A problem with any of such prior art systems is that the two half-mirrors each being inclined 45 degrees critically deteriorate the image-forming ability of a lens and, therefore, the quality of image reproduction even to an optically unallowable level. Another problem is that the ND filters are indispensable for the total sensitivity to the different separated colors of light to be balanced.

Further, when the incident angle to such half-mirrors which are installed in the optical system of a color copier is large, the half-mirrors are apt to reflect even needless color components, resulting in the deterioration of color separating ability. In addition, secondary reflections from the back of the half-mirrors are unwantedly introduced into the reflection path to bring about double exposure.

generally classified into two types, i.e., a filter constituted by a triacetate film which is provided with a color characteristic, and a filter constituted by a transparent glass on which a laminate coating is provided. The film type filter is inexpensive, but its transmission is low and light amount loss is great. The glass type filter, on the other hand, feature inherently high transmission, but it cannot cut the components appearing at both sides of a necessary wavelength range, unless the laminate coating is made up of a twice greater number of layers than in the case where the wavelengths at only one side is to be cut, at the sacrifice of cost.

It has been customary to selectively use ND filters, which serve to balance the total sensitivity to blue, green and red separated colors, which have certain transmission. When the voltage applied to a lamp of an illuminating unit is changed as in the case of a reduce copy mode or an enlarge copy mode operation, the transmission of the ND filter has to be changed to preserve the balance between the three different colors. However, the transmission of each ND filter is generally fixed and difficult to change it to another desired value.

Meanwhile, assume that a photoconductive element which is exposed imagewise through a first half-mirror positioned in the above optical path is a first photoconductive element, a one which is done so through a second half-mirror is a second photoconductive element, and a one which is done so through a third half-mirror is a third photoconductive element. Assuming that the first and second half-mirror are 3 millimeters each, the magnification errors and optical resolutions, or MTF (Modulation Transfer Function), of images which are projected onto the respective photoconductive elements are as shown below in Table 1.

TABLE 1

| | ITEM | | | |
|---|---|---|---|---|
| | UNDER OMTIMUM MTF CONDITION | | UNDER CONSTANT MAGNIFICATION CONDITION | |
| FOCUSING POSITION | MAGNIFICATION ERROR | MTF | MAGNIFICATION ERROR | MTF |
| 1ST ELEMENT | −0.14% | 52% | 0 | 41% |
| 2ND ELEMENT | −0.28% | 45% | 0 | 24% |
| 3RD ELEMENT | 0 | 32% | 0 | 32% |

Another implementation heretofore proposed to split the optical path into three segments is the use of a dichroic mirror in place of the half-mirrors. In case that a dichroic mirror which does not use transmitted light, i.e., a light intercepting mirror is used, a shutter or like light intercepting means has to be provided behind the mirror. Such an implementation, however, duffers from a drawback that the incident light is reflected not only by the front surface of the mirror (primary reflection) but also by the back of the mirror (secondary reflection), the secondary reflection introducing noise in the primary reflection to cause double exposure and lower color separating ability. While the secondary reflection may be excluded by providing a non-reflective coating on the back of the mirror, the coating often amounts to several tens of layers for functional reasons and, yet, providing such a non-reflective laminate coating requires disproportionate cost. Color separating filters extensively used to separate blue, green and red from three split beams of light include Wratten Nos. 47, 58 and 25 available from Kodak, and BPB-45, BPB-53 and SC-60 available from Fuji Photofilm. Such filters are It will be seen that under the optimum resolution condition the second photoconductive element suffers from a magnification error of −0.28% which means a contraction of image by 0.42 millimeters, compared to an image formed on the third photoconductive element. In a color copier, since toner images of different colors are superposed on a paper to reproduce a color image, any difference in magnification between the colors translates into misalignment of the images of respective colors, resulting in poor image quality. Furthermore, since the first and second half-mirrors are disposed in the optical path which terminates at the third photoconductive element, should the images projected onto the first to third photoconductive elements be of the same magnification, the MTF which are required to be greater than 50% would be lowered beyond 50% to result in a blurred image, as seen from Table 1.

SUMMARY OF THE INVENTION

It is therefore an object of the present invention to provide a color copier with an optical system which protects an image against deterioration despite the split of an optical path and color separation.

It is another object of the present invention to provide a color copier with an optical system which has remarkably improved color separating ability.

It is another object of the present invention to provide a color copier with an optical system which effectively uses light from a light source to allow a minimum of loss to occur concerning the amount of light.

It is another object of the present invention to provide a color copier with an optical system in which filters installed in an optical path can have their transmission changed as desired.

It is another object of the present invention to provide a color copier with an optical system which has a higher optical resolution (MTF) than the prior art optical systems.

It is another object of the present invention to provide a color copier with an optical system which enhances high-speed color copying.

It is another object of the present invention to provide a color and black-and-white copier which can be switched to a full-color copy mode and a black copy mode with ease and, in a black copy mode, allows a plurality of copies to be produced at a time by one exposure so as to increase the copying rate.

An optical system in accordance with the present invention is applicable to an electronic color copier in which latent images representative of an original document image, which is exposed through a slit, and each corresponding to a respective one of different colors are formed electrostatically one on each of at least a first to a third photoconductive elements, the latent images each being developed by a respective one of toner of a color which is associated with the latent image and, then, transferred to a paper in a superposed position. The optical system is characterized by comprising first optical path splitting means disposed in an optical path, along which incoming image light representative of the document image is propagated, for reflecting a part of the light over an entire width of the slit and transmitting a part of the light, second optical path splitting means located in a position for intercepting the light which is transmitted through the first optical path splitting means, the second optical path splitting means totally reflecting a part of the light, and third optical path splitting means for totally reflecting a remaining part of the light which is not reflected by the second optical path splitting means, whereby the light reflected by each of the first to third optical path splitting means is focused onto one of the first to third photoconductive elements which is associated with the optical path splitting means.

The above and other objects, features and advantages of the present invention will become more apparent from the following detailed description taken with the accompanying drawings.

DESCRIPTION OF THE PREFERRED EMBODIMENTS

Figure 1:
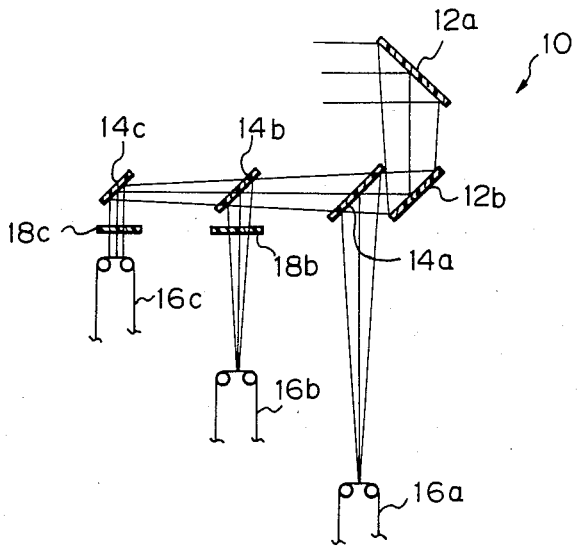
Fig. 1 PRIOR ART
FIG. 1 is a schematic view of an optical system which is installed in a prior art color copier.

In a prior art color copier of the type having three photoconductive elements, two half-mirrors and one total reflection mirror are disposed in those positions of an optical path which correspond to the respective photoconductive elements, so as to expose the photoconductive elements imagewise. FIG. 1 schematically shows an optical system commonly installed in a color copier. In this optical system, generally 10, light from an illuminating unit is reflected by total reflection mirrors 12a and 12b (simply referred to as mirrors hereinafter). Three half-mirrors 14a, 14b and 14c which reflect and transmit light over the entire width of a slit for exposure are located in an optical path along which the light reflected by the mirror 12b is propagated. Each of the half-mirrors 14a, 14b and 14c reflects any one of blue, green and red light so that images of the respective colors are focused onto a first photoconductive element 16a, a second photoconductive element 16b, and a third photoconductive element 16c. ND filters 18b and 18c are interposed, respectively, between the half-mirror 14b and the photoconductive element 16b and between the half-mirror 14c and the photoconductive element 16c. The resultant latent images electrostatically formed on the elements 16a to 16c are each developed by toner of any of yellow, magenta and cyan and, then, they are transferred one upon another and in register with each other to a paper which is transported making contact with the elements 16a to 16c sequentially.

As previously stated, a problem with the prior art optical system 10 is that the two half-mirrors which are disposed in the optical path are critically detrimental to the image-forming ability with respect to each photoconductive element, bringing the system 10 out of an optically allowable range in practice.

Figure 2:
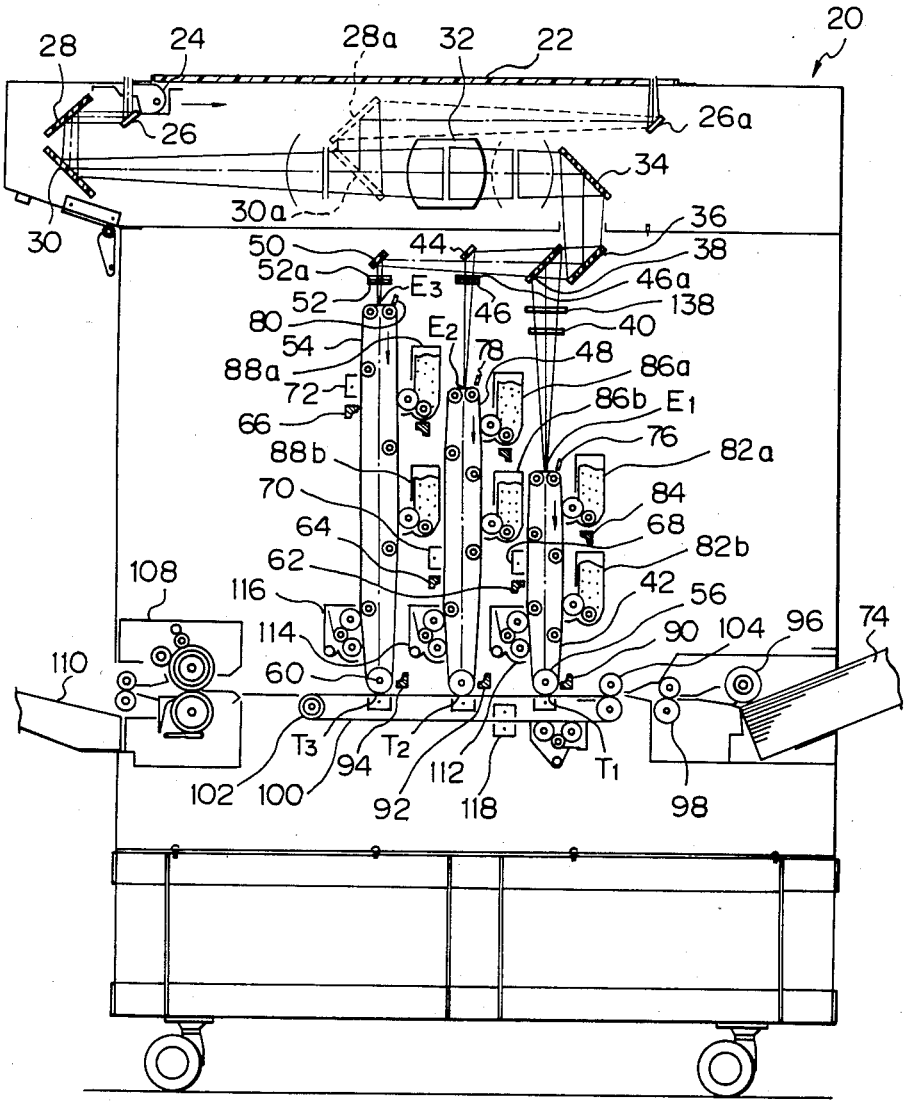
FIG. 2 is a vertical section of a color copier embodying the present invention.

Referring to FIG. 2, a color copier embodying the present invention is shown and generally designated by the reference numeral 20. While a document laid on a glass platen 22 is illuminated by an illuminating unit 24, a reflection from the document is propagated through mirrors 26, 28 and 30, a lens 32, and mirrors 34 and 36 to a first half-mirror 38. The half-mirror 38 reflects downward a part of a light beam incident thereto, i.e., light of any one of blue, green and red by a ratio which will be described, while transmitting the others therethrough. A blue color separating filter 40 is disposed in a reflection path, which extends from the half-mirror 38, so as to focus a blue light component onto a position $E_1$ on a first photoconductive element 42. The beam of the other two colors transmitted through the half-mirror 38 is split by a second mirror 44 which is located at a position where it intercepts light over a part of the width of a slit adapted for exposure. Of the light in the slit region of the second mirror 44, only the light of a particular color, i.e., a green light component is focused onto a position $E_2$ on a second photoconductive element 48 due to one or both of the spectral reflection characteristic of the mirror 44 and the spectral transmission characteristic of a color separating filter 46. The light outside the range of the mirror 44 causes its component of the remaining color, i.e., a red light component to be focused onto a position $E_3$ on a third photoconductive element 54, as determined by one or both of the spectral reflection characteristic of a third mirror 50 and the spectral transmission characteristic of a color separating filter 52.

In the above construction, the split of the optical path is such that the distribution of the different colors is effected purely optically and not through an iris or any other mechanical implements. The proportions of the respective colors are produced by the following procedure.

Assume that a photoconductive element has spectral sensitivity of $S\lambda$, a light source has a spectral energy distribution of $H\lambda$, a filter has spectral transmission (or a mirror has spectral reflection) of $F\lambda$, and a lens has spectral transmission $T\lambda$. Then, the amount of reaction of the photoconductive element $E\lambda$ is expressed as:

$$E\lambda = S\lambda \cdot H\lambda \cdot F\lambda \cdot T\lambda$$

Figure 3:
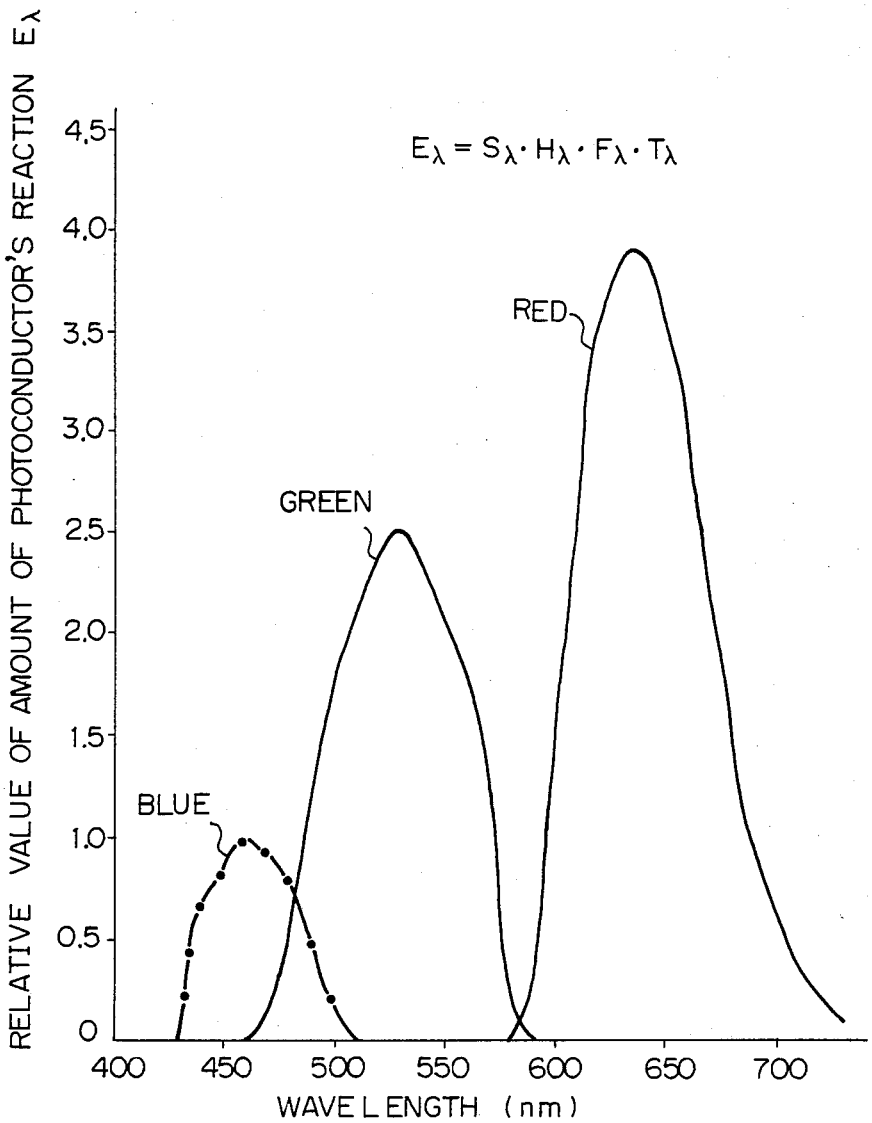
FIG. 3 is a graph representative of relative values of reaction which photoconductive elements assigned to individual colors show.

Using this equation, the relative values of reaction of a photoconductive elements which are assigned to different colors are obtained as shown in FIG. 3. Based on the relative values, there are produced proportions of distribution to the respective colors as shown in Table 2 below.

TABLE 2

| | TOTAL REACTION RATIO OF ELEMENT: E | 1/E | DISTRIBUTION RATIO | DISTRIBUTION RATIO OF TRANSMITTED LIGHT |
|---|---|---|---|---|
| Blue | 1.0 | 1.0 | 0.69 | — |
| Green | 3.6 | 0.28 | 0.19 | 0.61 |
| Red | 5.6 | 0.18 | 0.12 | 0.39 |

Specifically, the first half-mirror 38 reflects 69% of the entire amount of light and transmits 31%. By beam splitting, the second mirror 44 reflects 61% of the light transmitted through the first half-mirror 38 to project it onto the position $E_2$ of the second photoconductive element 48. The remaining 39% of the light which is not reflected by the mirror 44 is reflected by the third mirror 50 and focused onto the position $E_3$ on the third photoconductive element. The first to third photoconductive elements 42 to 54 are rotated, respectively, by drive rollers 56, 58 and 60 in the clockwise direction (as indicated by arrows).

First, the photoconductive elements 42, 48 and 54 are discharged by discharging lamps 62, 64 and 66, respectively, and then uniformly charged by chargers 68, 70 and 72, respectively. Under this condition, the elements 42, 48 and 54 are exposed imagewise at their positions $E_1$, $E_2$ and $E_3$ to the blue, green and red light components the amounts of which are, respectively, 69% of the total amount of light, and 61% and 39% of the light transmitted through the first half-mirror 38. In the meantime, an illuminating unit 24 which emits white light and mirrors 26, 28 and 30 are driven as indicated by arrows to those positions which are labeled 26a, 26b and 26c, respectively, while illuminating a document from its leading edge to its trailing edge. Each of the photoconductive elements 42, 48 and 54 now carrying an electrostatic latent image therewith is brought into a developing step after the charge on its surface except for a region which corresponds in size to a document or a paper 74 has been removed. In the developing step, the latent image on the first photoconductive element 42 is developed by developing units 82a and 82b with yellow toner which is complementary to blue. The reference numeral 84 designates a lamp which is interposed between the developing units 82a and 82b and turned on to enhance the tone of an image as needed. Exposed to the green component, the second photoconductive element 48 is developed by developing units 86a and 86b with magenta toner which is complementary to green. The third photoconductive element 54 which is exposed to the red component is developed by developing units 88a and 88b with cyan toner. The surfaces of the elements 42, 48 and 54 on which the individual toner elements are provided are discharged, respectively, by pretransfer discharging lamps 90, 92 and 94 and, then, advanced to transfer positions $T_1$, $T_2$ and $T_3$ for the transfer of the toner images onto the pape 74.

The paper 74 is fed by a feed roller 96 to a regist roller 98 and, then, driven to a conveyor belt 100 at such a timing that the paper 74 aligns with the toner image on the first photoconductive element 42. The belt 100 is driven by a drive roller 102 in the counterclockwise direction as viewed in FIG. 2. As the paper 74 driven by the regist roller 98 at the predetermined timing reaches the transfer position $T_1$ of the photoconductive element 42 while being held between a presser roller 104 and the belt 100, the yellow toner image is transferred from the element 42 to the paper 74 by a transfer charger 106. As the paper 74 is further driven to reach the position $T_2$, the magenta toner image is transferred thereto from the second photoconductive element 48. At the position $T_3$ which follows the position $T_2$, the cyan toner is transferred from the third photoconductive element 54 to the paper 74. Consequently, the paper 74 coming out of the position $T_3$ has thereon a superposed image of the yellow, magenta and cyan image components.

To register the yellow, magenta and cyan toner images on the paper 78, assuming that the circumferential lengths of the first to third photoconductive element 42, 48 and 54 as measured from the exposing position to the transferring position each are $E_1T_1$, $E_2T_2$ and $E_3T_3$, respectively, and that the distances between the transferring positions are $T_1T_2$, $T_2T_3$ and $T_1T_3$, an arrangement is so made to satisfy the following equations:

$$E_1T_1+T_1T_2=E_2T_2$$

$$E_1T_1+T_1T_3=E_2T_2+T_2T_3=E_3T_3$$

The paper 74 with the superposed image is separated from the belt 100 as it reaches a position adjacent to the drive roller 102, then transported through a fixing unit 108 to fix the image, and then driven out onto a tray 110.

The photoconductive elements 42, 48 and 54 are cleaned by their associated cleaning units 112, 114 and 116 of the toner remaining thereon after the image transfer, then discharged by the lamps 62, 64 and 68, and then transported to the next step. On the other hand, the belt 100 is discharged by a discharger 118 and, then, cleaned by an exclusive cleaning unit 120.

In a color copier having the above construction, assuming that the first half-mirror 38 is 3 millimeters thick, and that the magnification is constant, the optical resolutions of images which are individually projected onto the photoconductive elements 42, 48 and 54, i.e., MTFs as shown in Table 3 below are obtained.

TABLE 3

| | ITEM | | | | | |
|---|---|---|---|---|---|---|
| | PRIOR ART | | | | INVENTION | |
| | UNDER OMTIMUM MTF CONDITION | | UNDER CONSTANT MAGNIFICATION CONDITION | | UNDER CONSTANT MAGNIFICATION CONDITION | |
| FOCUSING POSITION | MAGNIFICATION ERROR | MTF | MAGNIFICATION ERROR | MTF | MAGNIFICATION ERROR | MTF |
| 1ST ELEMENT | −0.14% | 52% | 0 | 41% | 0 | 50% |
| 2ND ELEMENT | −0.28% | 45% | 0 | 24% | 0 | 53% |
| 3RD ELEMENT | 0 | 32% | 0 | 32% | 0 | 51% |

As shown in Table 3, the MTF associated with the first photoconductive element 42 is 50%, the MTF associated with the second photoconductive element 48 is 53%, and the MTF associated with the third photoconductive element 54 is 51%. Thus, all of the MTFs are higher than 50% and, therefore, superior to those attainable with the prior art arrangement of FIG. 1.

Another arrangement for implementing the split of an optical path will be described with reference to FIGS. 4A and 4B. This alternative arrangement splits an optical path in terms of a ratio in area.

Figure 4A:
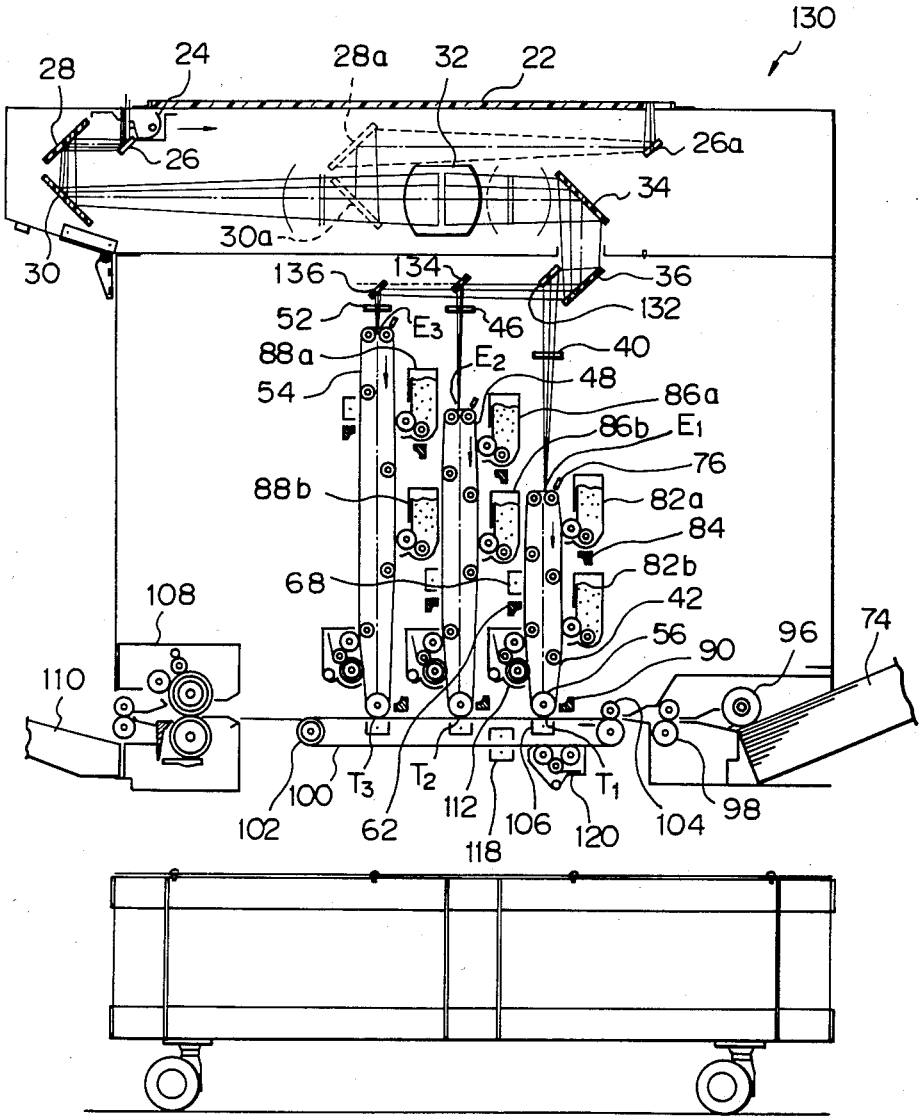
FIGS. 4A and 4B are views showing a modification to the embodiment of FIG. 2.

Referring to FIG. 4A, there is shown a copier in accordance with the present invention to which such an optical path splitting principle is applied. In FIG. 4A, the same or similar structural elements as those shown in FIG. 2 are designated by like reference numerals. In this copier, generally 130, light illuminated a document which is laid on the glass platen 22 is led to a first mirror 132 through the mirrors 26, 28 and 30, lens 32, and mirrors 34 and 36. The mirror 132 is located at such a position that it intercepts 69% of the entire light beam. That part of the light beam which is not reflected by the first mirror 132 is reflected by a second mirror 134 and a third mirror 136. While the second mirror 134 reflects 61% of light which is not reflected by the mirror 132, the third mirror 136 reflects 39% of the light which is not reflected by the second mirror 134, i.e., by the first mirror 132. A specific arrangement of the first to third mirrors 132 to 136 is shown in FIG. 4B. Reflections from the mirrors 132 to 136 are projected, respectively, onto the positions $E_1$, $E_2$ and $E_3$ of the first to third photoconductive elements 42 to 54 by their individual proportions. Although the optical path which extends from the third mirror 136 is narrower than the others, as regards the focusing ability, it does not entail any deterioration of image quality which is particular to the prior art 45-degrees inclined half-mirror type scheme.

Although the split of the optical path is somewhat effected in distribution ratio by magnification owing to the edges of the mirrors, the change in distribution ratio is insignificant at and around a 1 magnification. In the case that the distribution ratio is noticeably changed due to a substantial change in magnification and other causes, a program may be designed such that the edge of each mirror is moved in parallel within its plane to maintain the distribution ratio constant despite a change in magnification and, therefore, a change in beam width.

Figure 4B:
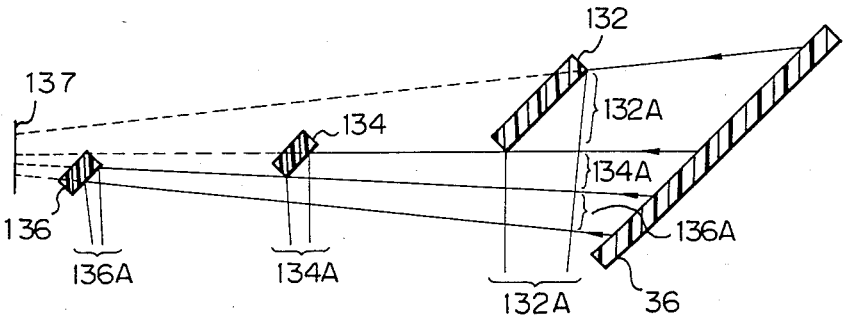

An advantage attainable with the use of three mirrors as shown in FIG. 4A or 4B is as follows.

Figure 4C:
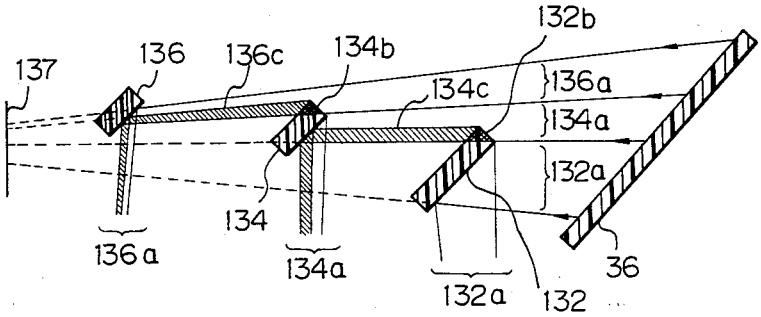
Fig. 4C PRIOR ART
FIG. 4C is a view of a prior art optical system using three mirrows.

FIG. 4C shows a prior art optical system of the type using three mirrors. In this optical system, light is partly effected by the corners of the mirrors 132 and 134 due to their thickness, limiting the efficient use of light. Specifically, while light from a light source which is reflected by the mirror 36 is directed toward a virtual image-forming plane 137, that light is roughly split into a bottom layer layer 132*a*, an intermediate layer 134*a*, and a top layer 136*a* with respect to a plane which is parallel to the light-receving plane of each photoconductive element. The bottom layer 132*a* is reflected by the mirror 132, the intermediate layer 134*a* is reflected by the mirror 134, and the top layer 136*a* is reflected by the mirror 136. The proportions in sectional area of the layers 132*a*, 134*a* and 136*a* are determined by the spectral transmission of color separating filters and the spectral sensitivity of photoconductive elements. Since the mirrors 132, 134 and 136 are inclined by about 45 degrees each, with respect to the direction of a reflection from the mirror 36, the light beams in the layers 134*a* and 136*a* are partly effected by, respectively, the corners of the mirrors 132 and 134 (double-hatched portions) as represented by hatched areas 134*c* and 136*c*, due to the thickness of the mirrors 132 and 134. Consequently, the amount of light in each layer 134*a* or 136*a* is correspondingly reduced, resulting in a short amount of light. While such a problem may be solved by shaving the corners 132*b* and 136*b* of the mirrors 132 and 134, such not only requires extra machining steps as well as extra cost but also affects the accuracy of reflecting surfaces to deteriorate an image reproduced.

In the light of this, as shown in FIG. 4B, the light reflected by the mirror 36 is divided into three beam layers 132A, 134A and 136A as named from the top to the bottom, i.e., from the one which is remotest from the light-sensitive surfaces of the photoconductive elements., so that they are sequentially reflected by the mirrors 132, 134 and 137 toward their associated photoconductive elements. In this configuration, none of the top triangular bulges of the mirrors intercepts the underlying beam layers and, hence, each beam layer is fully reflected to illuminate its associated light-sensitive surface. This prevents the amount of light from being reduced and, thereby, enhances efficient use of light.

While the foregoing description has concentrated on the split of a light beam having a relatively great width, the principle described above is naturally applicable to a light beam which is shaped by a relatively narrow slit, i.e., a one used in a color scanner and other beam split type color image data reading devices, and a one used in an optical system installed in a laser printer and operated to modulate primary diffraction light of different angles of a single laser beam with image data signals of different colors and, thereby, write the resultant images on independent photoconductive elements.

As previously stated, the half-mirror 38 shown in FIG. 2 reflects one of blue, green and red light components of the light beam which extends over the entire width of the exposing slit while transmitting the other two light components, the transmitted light being split in a slit configuration by the mirror 44. It follows that the light which is to be reflected by the half-mirror 38 should preferably be of the color to which a photoconductie element shows the most insignificant reaction with the spectral sensitivity characteristic of the photoconductive element and the spectal characteristics of a color separating filter and a lens taken into consideration, from the viewpoint of efficient use of light and rapid color copying.

Figure 5:
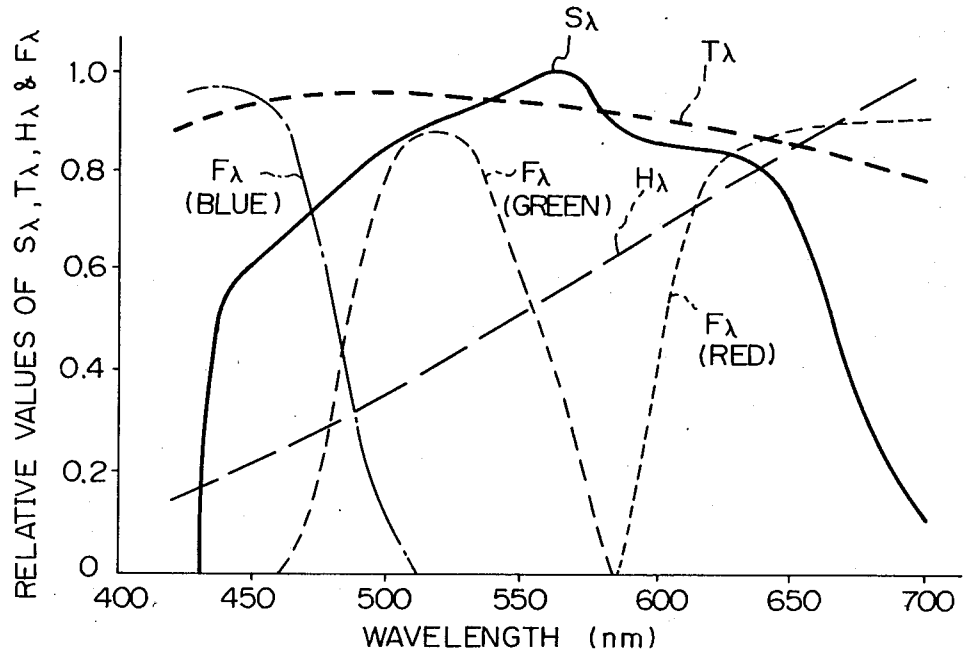
FIG. 5 is a graph showing relative values of spectral transmission of a lens, spectral sensitivity of a photoconductive element, energy distribution of a light source, and spectral transmission of each filter.

While FIG. 3 shows relative values of the amounts of reaction Eλ of the respective photoconductive elements, FIG. 5 shows examples of the spectral sensitivity Sλ of a photoconductive element, the spectal energy distribution Hλ of a light source, the spectral transmission Tλ of a lens, and the spectral transmission Fλ of a blue, a green, and a red filter. It is to be noted that the spectral sensitivity Sλ shown in FIG. 5 exemplifies spectral sensitivity characteristics of photoconductive elements which are made of organic photosemiconductors.

The proportions of the amounts of reaction Eλ of photoconductive elements which are individually responsive to blue, green and red light are equal to the proportions of those areas which are delimited by the respective curves as shown in FIG. 3. Specifically, it was found that the ratio is blue:green:red=1.0:3.6:5.6. This implies that blue to which the most insignificant reaction is exhibited should be the color to be reflected by the half-mirror 38.

How the green and red components which are transmitted through the half-mirror 38 should be distributed to be balanced with the amount of reaction to the blue component will be described. Such a distribution is achievable by equalizing the total amount of reaction of the photoconductive elements to green and red to the amount of reaction to blue, i.e., 1.0.

Exemplary combinations of the amounts of reaction mentioned above are shown in Tables 4, 5 and 6 below.

TABLE 4

| | ITEM | | | | |
|---|---|---|---|---|---|
| COLOR | REACTION RATIO OF ELEMENT | SLIT WIDTH RATIO | | ND FILTER TRANSMISSION T | TOTAL REACTION OF ELEMENT E × W × T |
| BLUE | 1.0 | 1.0 | | — (100%) | 1.0 |
| GREEN | 3.6 | 0.5 | TOTAL | 56% | 1.0 |
| RED | 5.6 | 0.5 | 1.0 | 36% | 1.0 |

TABLE 5

| | ITEM | | | |
|---|---|---|---|---|
| COLOR | REACTION RATIO OF ELEMENT | SLIT WIDTH RATIO | ND FILTER TRANSMISSION T | TOTAL REACTION OF ELEMENT E × W × T |
| BLUE | 1.0 | 1.0 | — (100%) | 1.0 |

TABLE 5-continued

| COLOR | REACTION RATIO OF ELEMENT | SLIT WIDTH RATIO | | ND FILTER TRANSMISSION T | TOTAL REACTION OF ELEMENT E × W × T |
|---|---|---|---|---|---|
| | ITEM | | | | |
| GREEN | 3.6 | 0.28 | TOTAL | — (100%) | 1.0 |
| RED | 5.6 | 0.72 | 1.0 | 25% | 1.0 |

TABLE 6

| COLOR | REACTION RATIO OF ELEMENT | SLIT WIDTH RATIO | | ND FILTER TRANSMISSION T | TOTAL REACTION OF ELEMENT E × W × T |
|---|---|---|---|---|---|
| | ITEM | | | | |
| BLUE | 1.0 | 1.0 | | — (100%) | 1.0 |
| GREEN | 3.6 | 0.82 | TOTAL | 34% | 1.0 |
| RED | 5.6 | 0.18 | 1.0 | — (100%) | 1.0 |

Figure 6:
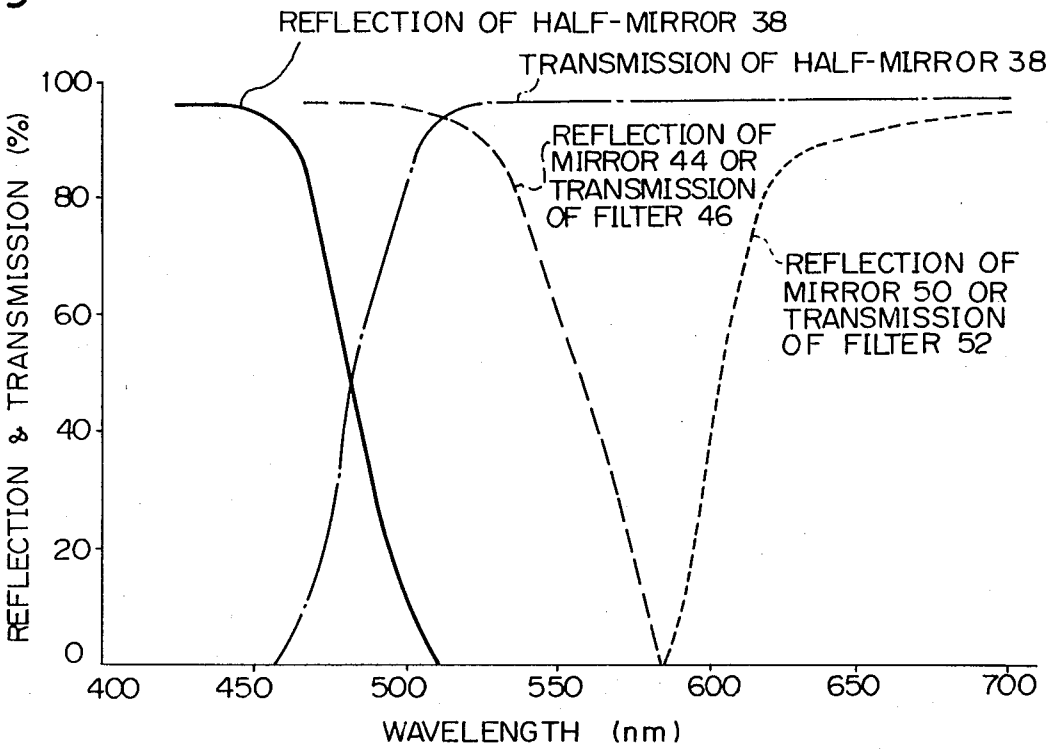
FIG. 6 is a graph showing reflection or transmission of respective mirrors.

In this case, the spectral reflection and transmission characteristics of the half-mirror 38, mirrors 44 and 50, and filters 46 and 52 are combined as shown in FIG. 6 so as to provide the Fλ characteristics of FIG. 5.

As regards the green light, its characteristic is the combination of the transmission characteristic of the half-mirror 38 and the reflection characteristic of the mirror 44 or the transmission characteristic of the filter 46. From the color separation standpoint, if the transmission and interception region is excessively offset toward the short wavelength side (such would occur if the reflection characteristic were determined first with importance placed on the color separation of blue light), it is necessary for the short wavelength region of green light to be shifted toward the long wavelength side. In such a case, desired color separation may be implemented by providing the mirror 44 or the filter 46 with a band type characteristic, which reflects or transmits a necessary wavelength region, and not with the characteristic of FIG. 6 or, alternatively, by adopting a combined system in which while the mirror 44 is provided with the characteristic of FIG. 6, the filter 46 is provided with transmission and inteception characteristics on the longer wavelength side than the half mirror 38.

When use was made of photoconductive elements which were made of a selenium (Se)-based material and showed a different spectral sensitivity characteristic (Sλ, not shown) from that of FIG. 5, the amounts of reaction Eλ associated with the respective colors were found to in a ratio: blue:green:red=2.8:2.1:1.0. All that is required in this situation is causing the half-mirror 38 to reflect the red component while transmitting the blue and green components, and making the total amount of reaction of the photoconductive elements to the blue and green components equal to the amount of reaction to the red component on the basis of the combination of the split ratio particular to the mirror 44 and the ND filter. Such may be accomplished by the exemplary combination shown in Table 7.

TABLE 7

| COLOR | REACTION RATIO OF ELEMENT | SLIT WIDTH RATIO | | ND FILTER TRANS-MISSION T | TOTAL REACTION OF ELEMENT E × W × T |
|---|---|---|---|---|---|
| | ITEM | | | | |
| BLUE | 2.8 | 0.52 | TOTAL | 69% | 1.0 |
| GREEN | 2.1 | 0.48 | 1.0 | — (100%) | 1.0 |
| RED | 1.0 | 1.0 | | — (100%) | 1.0 |

Figure 7:
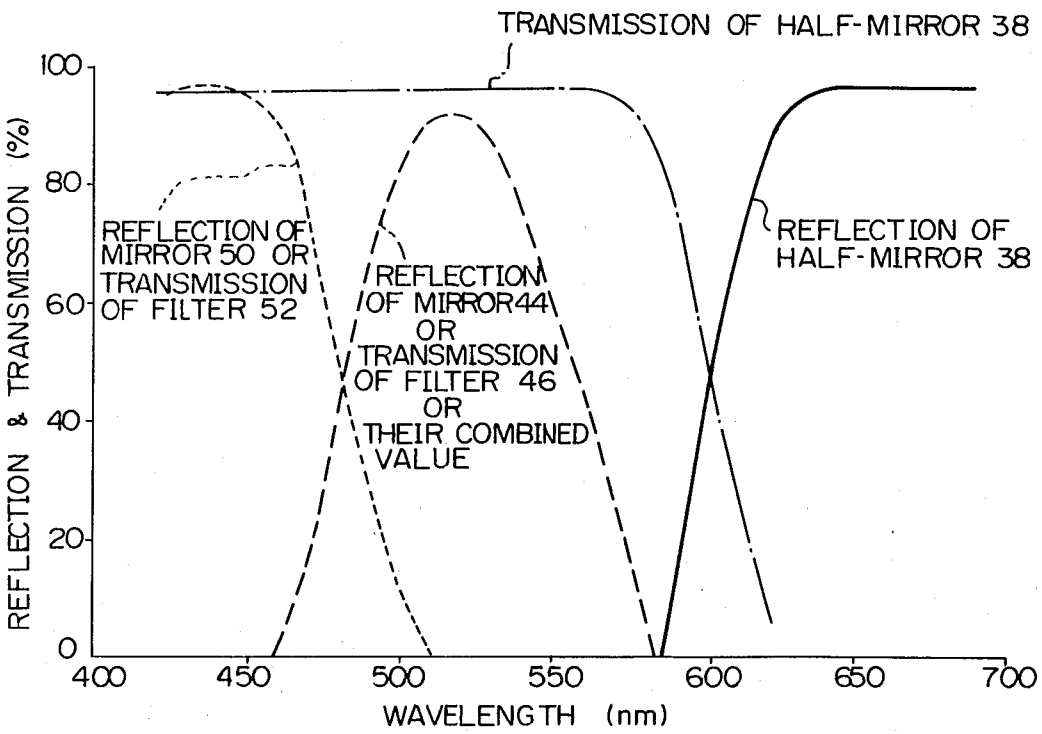
FIG. 7 is a graph showing reflection or transmission of respective mirrors in relation to the use of photoconductive elements which are made of selenium-based material.

In the above condition, the spectral reflection and transmission characteristics of the half-mirror 38, mirrors 44 and 50 and filters 46 and 52 are determined as shown in FIG. 7 so as to provide the Fλ characteristics of the respective colors as shown in FIG. 5.

In this particular embodiment, since the half-mirror 38 is adapted to reflect the red component, cyan toner which is complementary to red is stored in the developing units 82*a* and 82*b*. Hence, magena tonger is stored in the developing units 86*a* and 86*b*, and yellow toner in the developing units 88*a* and 88*b*.

Even when the spectral characteristic of a light source and those of a filter, lens and others are different from those mentioned above, the combination will be determined adopting the the same principle.

Figure 8:
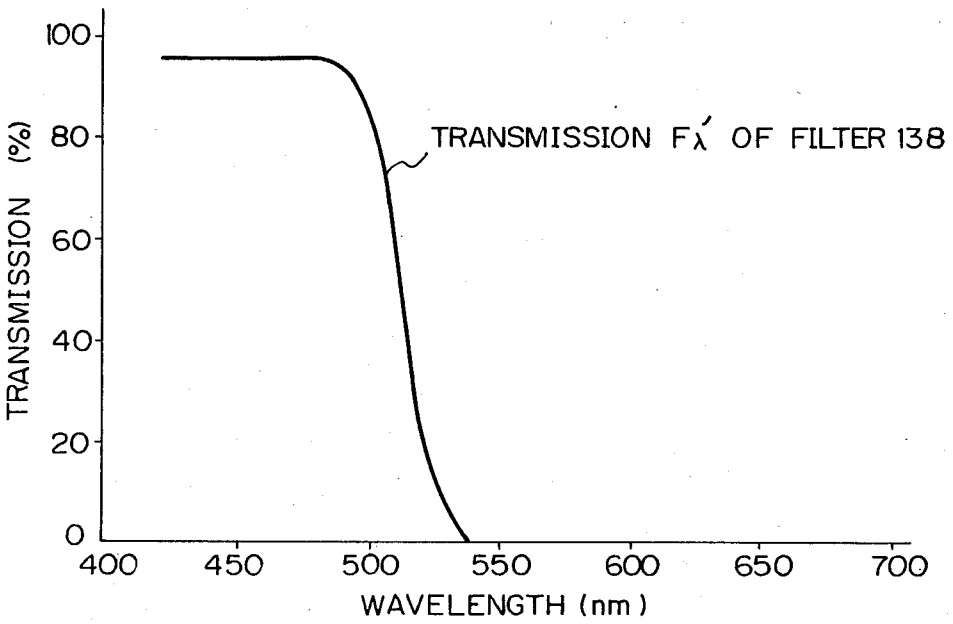
FIG. 8 is a plot showing a characteristic of a long wavelength cut filter.

As regards the half-mirror 38 installed in the color copier 20 of FIG. 2, when the incident angle to the half-mirror 38 is substantial, the half-mirror 38 reflects even the light of needless colors resulting in poor color separating ability. In addition, a secondary reflection from the back of the half-mirror 38 is introduced into the reflection path to bring about a double exposure problem. To solve these problems, a long wavelength cut filter 138 is disposed in the optical path which is associated with the half-mirror 38 of the color copier 20 (see FIG. 2). As shown in FIG. 8, the spectral transmission characteristic of the filter 138 is such that the filter 138 transmits those light having short wavelengths but not those having wavelengths greater than 500 nanometers at all.

As mentioned earlier, FIG. 6 shows ideal reflection and transmission characteristics of the half-mirror 38. Specifically, the half-mirror 38 ideally shows reflection of 0% and transmission of 100% at the wavelengths greater than 500 nanometers. In practice, however, the half-mirror 38 reflects a fraction of the light whose wavelength is greater than 500 nanometers when the incident light $\theta$ is 45 degrees, as represented by a solid curve in FIG. 9.

As previously mentioned, the amount of spectral reaction Eλ of a photoconductive element is produced by:

$$E\lambda = S\lambda \cdot H\lambda \cdot F\lambda \cdot T\lambda$$

where Sλ is the spectral sensitivity of the photoconductive element, Hλ is the spectral energy of the light source, Fλ is the spectral reflection of the half-mirror 38, and Tλ is the spectral transmission of the lens 32.

Figure 10:
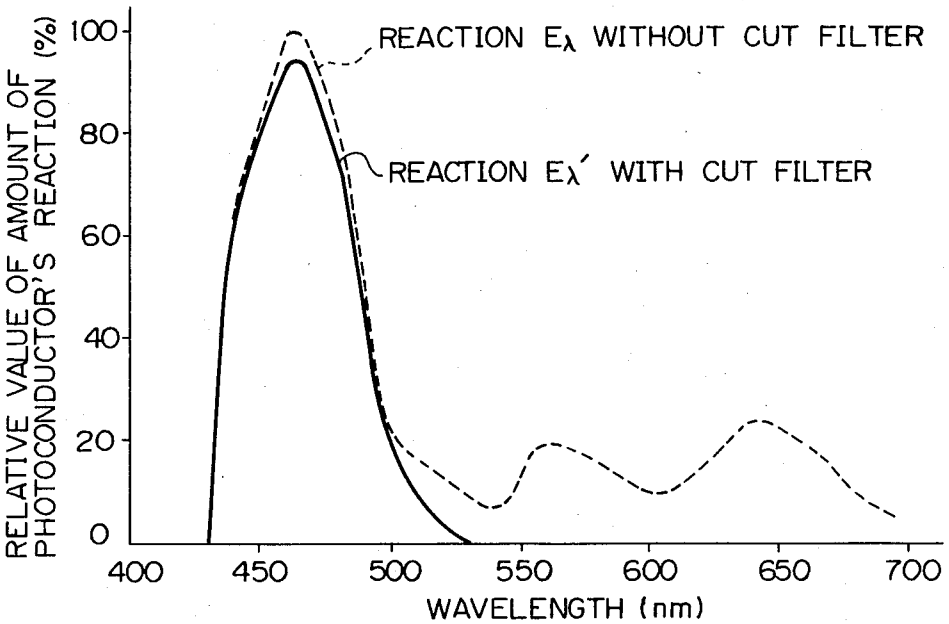
FIG. 10 is a graph showing amounts of spectral reaction of a photoconductive element.

Then, assuming that the photoconductive element is made of an organic photosemiconductor, and that the light source is implemented with a halogen lamp (Tλ being substantially constant), the amount of spectral reaction Eλ of the photoconductive element is varied as represented by a dotted curve in FIG. 10. On the other hand, when the amount of reaction Eλ is multiplied by the spectral transmission F'λ of the long wavelength cut filter 138, i.e., when the filter 138 is disposed in the optical path which is associated with the half-mirror 38, the amount of spectral reaction E'λ is practically zero for the wavelengths greater than 500 nanometers, as represented by a solid curve in FIG. 10 (refer to the case of blue of FIG. 2). This proves that the filter 138 installed in the optical path allows only the blue light component to be separated.

Figure 11:
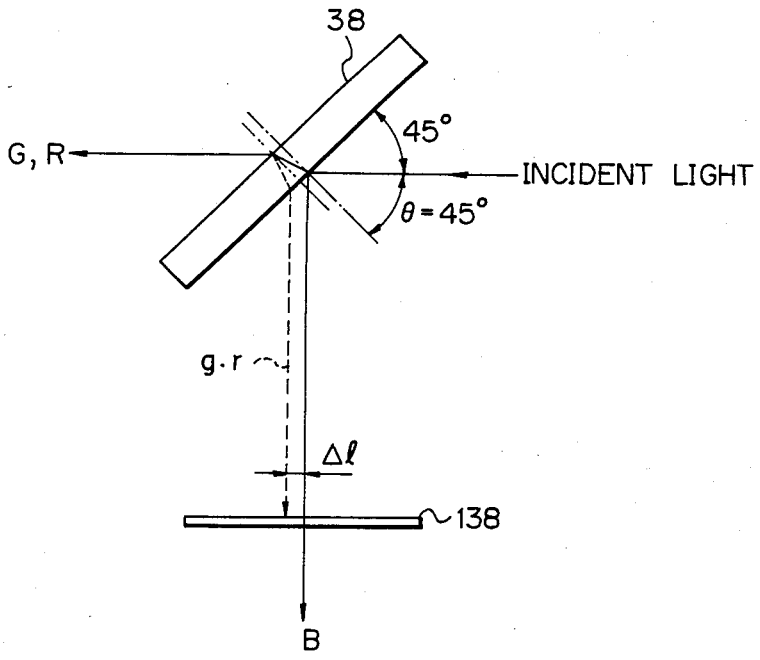
FIG. 11 is is a shematic diagram showing a reflecting condition of a half-mirror.

Referring to FIG. 11, there are shown a primary reflection B from the half-mirror 38 which is disposed in the optical path in a 45-degrees inclined position, and a secondary reflection g·r of green and red light G and R which is transmitted through the half-mirror 38. Among all light components incident to the half-mirror 38, the blue component B which is the primary reflection is reflected by the surface of the half-mirror 38 and, because its wavelength is shorter than 500 nanometers, transmitted through the long wavelength cut filter 138 to reach the photoconductive element. On the other hand, the green and red components G and R being propagated through the half-mirror 38 are partly reflected within the half-mirror 38, resulting that the secondary reflection g·r tends to reach that point of the photoconductive element which is deviated by Δl from the dblue or primary reflection B. However, since the filter 138 does not transmit light of those colors whose wavelengths are greater than 500 nanometers, the secondary reflection g·r is intercepted before reaching the photoconductive element.

When the color of light to be reflected by the half-mirror 38 is other than blue, i.e., green or red as may occur in relation to the material of the photoconductive element and the kind of the light source, what is needed is simply disposing a filter which does not transmit light components except for the reflected one in the optical path which extends from the half-mirror 38.

Figure 12:
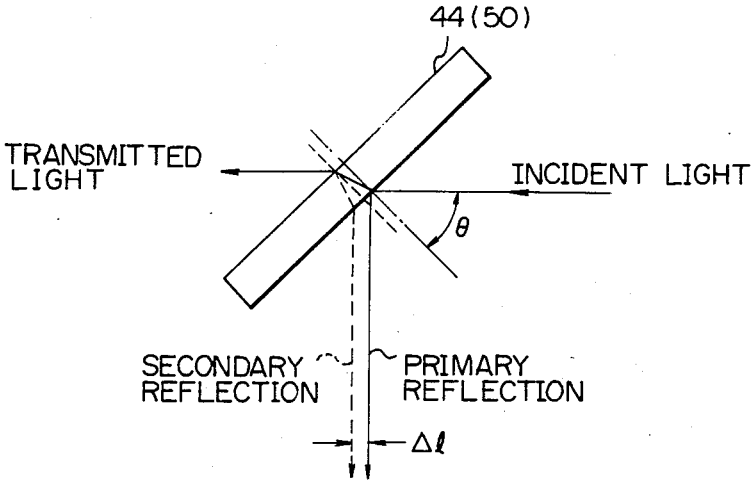
FIG. 12 is a view useful for explaining light incident to and reflected by a total reflection mirror.

Concerning the mirrors 44, 50, 132, 134, 36 shown in FIGS. 2, 4A and 4B, each reflects not only a primary reflection of an essential separated color but also a primary reflection of a color other than the essential one, the latter being reflected by the back of the mirror at a slightly deviated position from the former. Such a secondary reflection entails double exposure as well as deterioration of color separation. This undesirable phenomenon will be discussed using the second mirror 44 and the third mirror 50 of FIG. 2 by way of example and with reference made to FIG. 12. As regards the mirror 44, it reflects a primary or green reflection and, at the back thereof and in a position deviated by Δl from the primary reflection, a secondary or red reflection. Likewise, the mirror 50 produces a secondary or green reflection in addition to a primary or red reflection. Moreover, since the mirrors 44 and 55 are not required to transmit light and, rather, required not to transmit light, extra light-intercepting means such as an iris has to be located at the back of the mirror 44.

Figure 13:
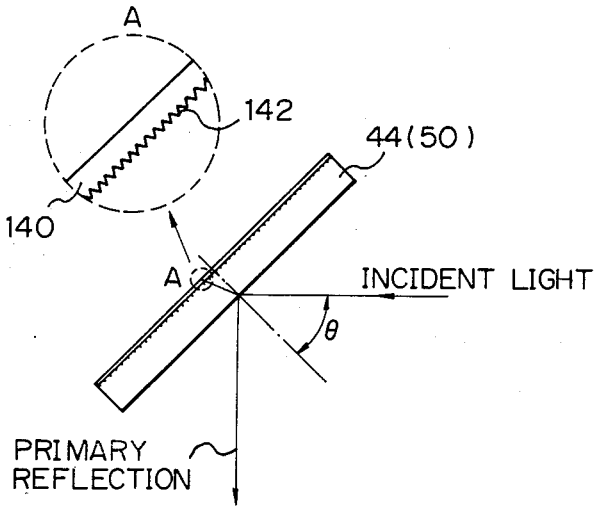
FIG. 13 is a view showing means which may be adopted to prevent secondary reflection and intercept transmission.

In the light of the above, as shown in FIG. 13, each of the mirrors 44 and 50 is provided with a light absorbing layer 140 which may be implemented with black painting, in order to absorb light incident thereto. In addition, if the back of each mirror 44 or 50 is provided with a rough surface 142, the light absorbing layer 140 will cooperated with the rough surface 142 to fully eliminate secondary reflections.

In this manner, in the case that transmission of light is needless and, rather, has to be removed, a light absorbing layer may be provided on the back of a dichroic mirror such as painting it in black. This eliminates secondary reflections which are the cause of double exposure and deterioration of color separation, while providing a light intercepting effect as well, by far more inexpensive and simple means than the prior art one, i.e., an expensive non-reflective coating which is made up of a plurality of layers.

So far as the red light is concerned, the secondary reflection can be eliminated with eash by using a filter having a spectral transmission characteristic which is commercially available at low cost, or even a mirror which lacks a color separating capability. As regards the blue and green light for which inexpensive filters showing good spectral transmission are not available, the countermeasure against double reflection in accordance with the present invention will prove further effective when applied to the combined arrangement wherein the first half-mirror 38 separates the red light and the second and third mirrors 44 and 50, the blue and green lights.

The half-mirror 38, the mirrors 44 and 50, and the color separating filters 40, 46 and 52 as shown in FIG. 2 will be described in more detail.

As stated earlier, the light from the light source which is reflected by the mirror 36 is split into three components by the half-mirror 38 and the mirrors 44 and 50, the three light components becoming incident to the photoconductive elements 42, 48 and 54 through the individual filters 40, 46 and 52. Naturally, but using the spectral transmission characteristics of the filters 40, 46 and 52, the spectral reflection and transmission characteristics of the half-mirror 38, and the spectral reflection characteristics of the mirrors 44 and 50, light of those wavelengths which do not lie in the ranges of the light which should be focused onto the individual photoconductive elements are cut.

Figure 14:
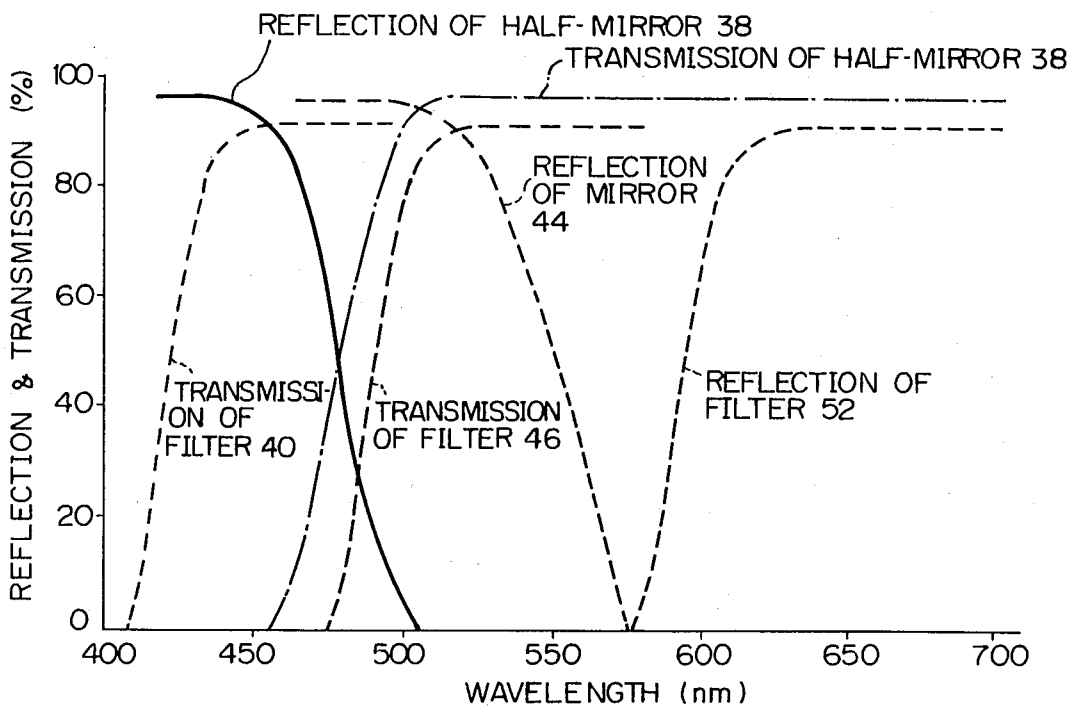
FIG. 14 is a graph showing reflection and transmission of respective mirrors and respective filters.

To begin with, there will be described the spectral reflection and transmission characteristics of the half-mirror 38, mirror 44 and 50, and filters 40, 46 and 52, as shown in FIG. 2, assuming a case wherein the split beams which are incident to the first to third photoconductive elements 42, 48 and 54 are separated into blue, green and red light, respectively. FIG. 14 shows spectral reflection and transmission of the half-mirror 44, spectral reflection of the mirror 44, and spectral transmission of the filters 40, 46 and 52, are exhibited in the above condition. As shown, the reflection and transmission characteristics of the half-mirror 38 is determined with importance placed on the separation of blue, i.e., with priority given to reflection. This is because the only implementation available to sharply cut the long wavelength side is a laminate coating type dichroic mirror, i.e., the filter 40, for example, cannot serve the correction. Once the reflection characteristic of the half-mirror 38 is determined, the transmission characteristic of the same is automatically given, as shown in FIG. 14. As for the mirror 44, use is made of a dichroic mirror which is provided with, by considering the separation of blue, a spectral reflection characteristic which is to sharply cut the long wavelength side, as also shown in FIG. 14. Further, the mirror 50 is implemented with an ordinary mirror having no color characteristic, and its spectral reflection curve is shown shown in FIG. 14.

The filter which are inserted in the respective split optical paths to determine the short wavelength side of the wavelength ranges of their associated split beams are implemented with those sharp-cut filters each being designed to sharply cut light of shorter wavelengths than predetermined ones, e.g. SC type triacetate film filters available from Fuji Photofilm. For the filter 40 which is disposed in the optical path 40 defined by the half-mirror 38, use is made of a filter whose transmission characteristic is such that light of wavelengths shorter than 420 nanometers is cut at and around the transmission of 50% as shown in FIG. 14, e.g. SC-42 available from Fuji Photofilm. The filter 46 inserted in the optical path which is defined by the mirror 44 is comprised of a filter whose transmission characteristic is such that light of wavelengths shorter than about 480 nanometers is cut at and around the transmission of 50% as also shown in FIG. 14, e.g. SC-48 available from Fuji Photofilm. Further, the filter 52 disposed in the optical path which is defined by the mirror 50 is implemented with a filter which cuts the light of wavelengths shorter than 600 namometers at the transmission of about 50% as shown in FIG. 14, e.g. SC-60 available from Fuji Photofilm.

Where the spectral reflection and transmission characteristics of the half-mirror 38, mirrors 44 and 50, and filters 40, 46 and 52 are set up as described above, the spectral characteristic of the light to which the first photoconductive element 42 is exposed is delimited on one hand by the reflection curve of the half-mirror 38 shown in FIG. 14 and on the other hand by the transmission curve of the filter 40. The spectral characteristic of the light which illuminates the second photoconductive element 48 is sandwitched between the reflection curve of the mirror 40 and the transmission curve of the filter 46. Further, the spectral characteristic of the light which illuminates the third photoconductive element 54 is positoned on the longer wavelength side than the transmission curve of he filter 52. Consequently, the split beams of light are separated into blue, green and red.

Figure 15:
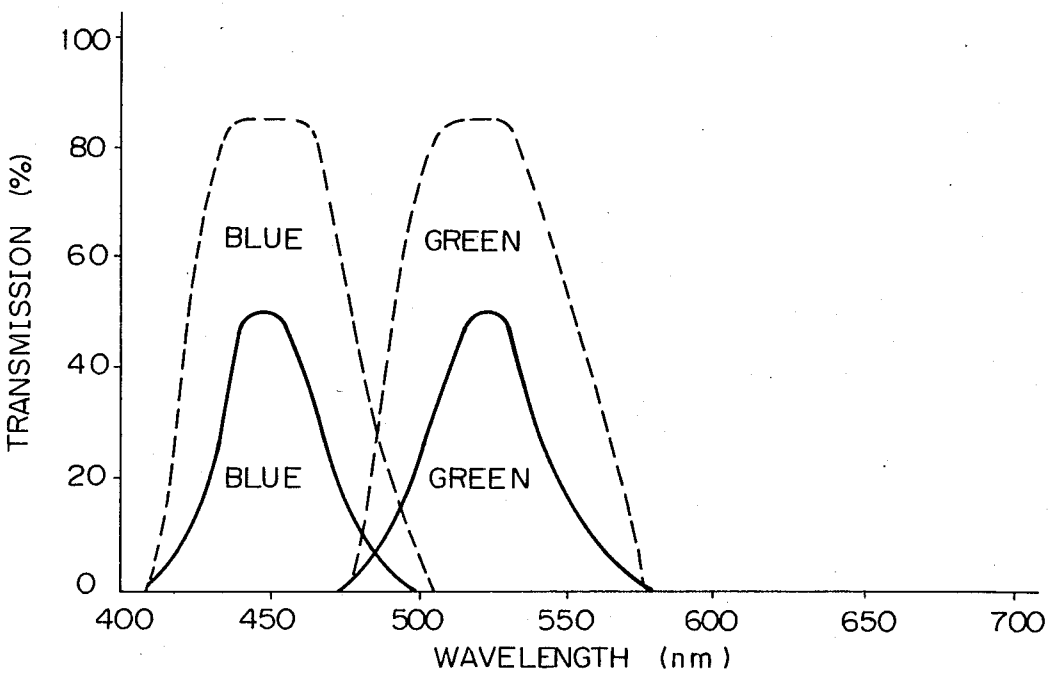
FIG. 15 is a graph showing spectral transmission of a color separating filter.

The spectral characteristics of the split light beams which are individually directed toward the photoconductive elements 42 and 48 are analogous to the spectral transmission characteristics of filters which are highly transmissive for blue and green light, as represented by dotted curves in FIG. 15. Those filters are of the kind having a laminate coating provided on a transparent glass. In FIG. 15, the solid curves are representative of the transmission characteristics of filters which are extensively used today and implemented with triacetate films having color characteristics.

It is to be noted that the filter 40 is needless if the first photoconductive element 42 has a spectral sensitivity characteristic which sharply falls at about 430 nanometers and onward.

Next, there will be described a case wherein the first photoconductive element 42 is exposed to red light, the second photoconductive element 48 to green light, and the third photoconductive element to blue light. In this alternative condition, the developing units **82*a* and 82*b*, 86*a* and 86*b* and 88*a* and 88*b* should naturally be furnished with cyan toner, magenta toner, and yellow toner, respectively. The spectral transmission and reflection characteristics of the half-mirror 38, mirrors 44 and 50, and filters 40, 46 and 52 which apply to this particular case are shown in FIG. 16**.

Figure 16:
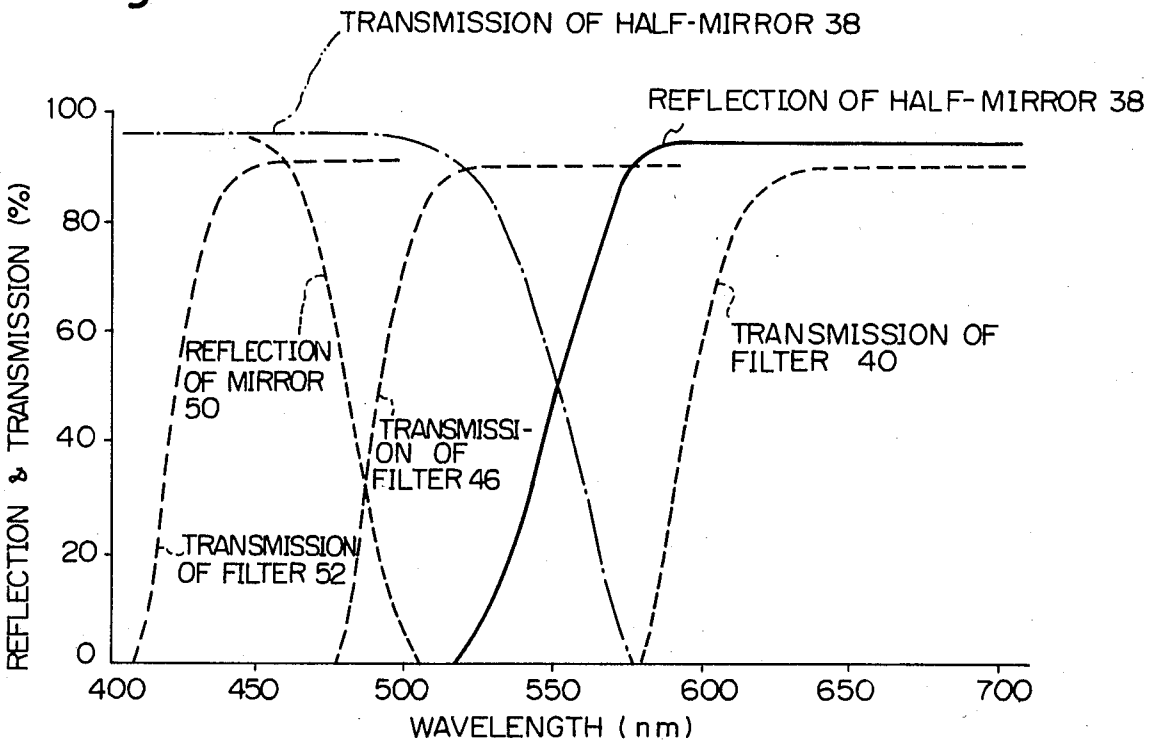
FIG. 16 is a graph showing reflection and transmission of respective mirrors and respective filters.

First, the spectral transmission characteristic of the half-mirror 38 is selected as shown in FIG. 16 in consideration of limiting the long wavelengths of green separated light. Consequently, the spectral reflection characteristic of the half-mirror 38 is also determined as shown in FIG. 16. As shown, the curve representative of the reflection characteristic of the half-mirror 38 is offset toward the short wavelength side so far as red separated color is concerned, the filter 40 is implemented with a sharp cut filter which cuts shorter waves than 600 nanometers, so as to allow red light lying in a predetermined wavelength range to reach the first photoconductive element 42. For the mirror 44, an ordinary mirror which lacks color characteristics is used. The filter 46 is comprised of a filter which cuts waves shorter than about 480 nanometers, as has been the case with the previous situation. The mirror 50 is comprised of a dichroic mirror having such a spectral reflection characteristic as a one shown in FIG. 16. Further, the filter 52 is implemented with a filter which cuts shorter waves than about 420 nanometers at the transmission of 50%.

In the above arrangement, the first photoconductive element 42 is exposed to red light whose short wavelength side with respect to the transmission curve of the filter 40 has been cut; the second photoconductive element 48 is exposed to green light having a spectral characteristic which is sandwitched between the transmission curve of the half-mirror 38 and that of the filter 46; and the third photoconductive element 54 is exposed to blue light whose spectral characteristic is sandwitched between the reflection curve of the mirror 50 and the transmission curve of the filter 52. Again, the filter 52 is omissible depending upon the spectral sensitivity characteristic of its associated photoconductive element.

The blue and green spectral characteristics mentioned above are analogous to the filter characteristics which are represented by dotted curves in FIG. 15, enhancing light efficiency to a significant degree.

The ND filters **46*a* and 52*a*** which are installed for the adjustment of the amount of light as needed will be described in detail.

As previously stated, it is a common practice to selectively use ND filters each showing predetermined transmission. When the voltage applied to a lamp of an illuminating unit is varied as in a reduce mode or an enlarge mode copying operation, it is necessary for the transmission of the ND filter to be changed in order to maintain the balanced condition of the respective separated colors. However, since the transmission of an ND filter is usually fixed, changing it to a desired value is almost imparacticable. In accordance with the present invention, use is made of liquid crystal filters for the ND filters so that the transmission may be changed by controlling the voltage which is applied to liquid crystal.

Figure 17:
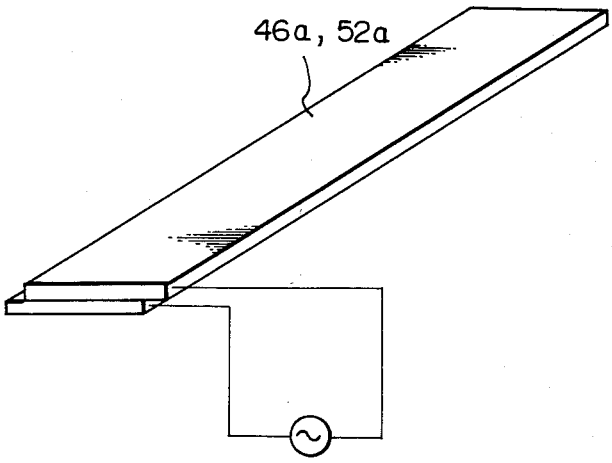
FIG. 17 is a view showing a specific contruction of a liquid crystal filter.
Figure 18:
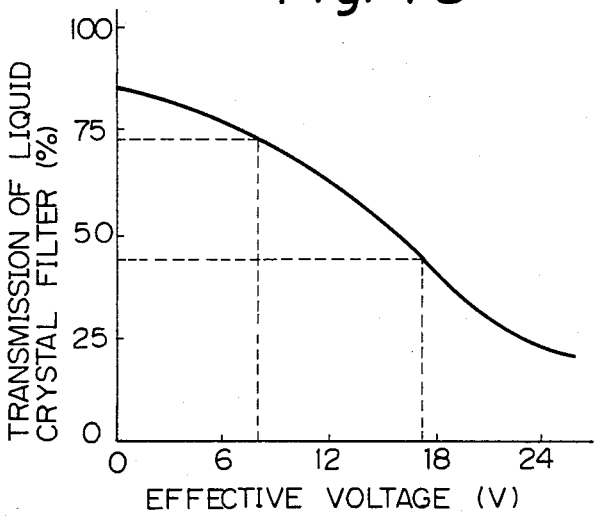
FIG. 18 is a graph showing an exemplary voltage-to-transmission characteristic of a liquid crystal filter.

FIG. 17 shows an exemplary liquid crystal filter while FIG. 18 shows an exemplary voltage-to-transmission curve particular to the liquid crystal filter. It is to be noted that in FIG. 18 the voltage is implemented with a bipolar square wave having a frequency of 64 hertz. How the balance of light amount should be adjusted in response to a change in the voltage applied to a lamp is as follows.

Figure 9:
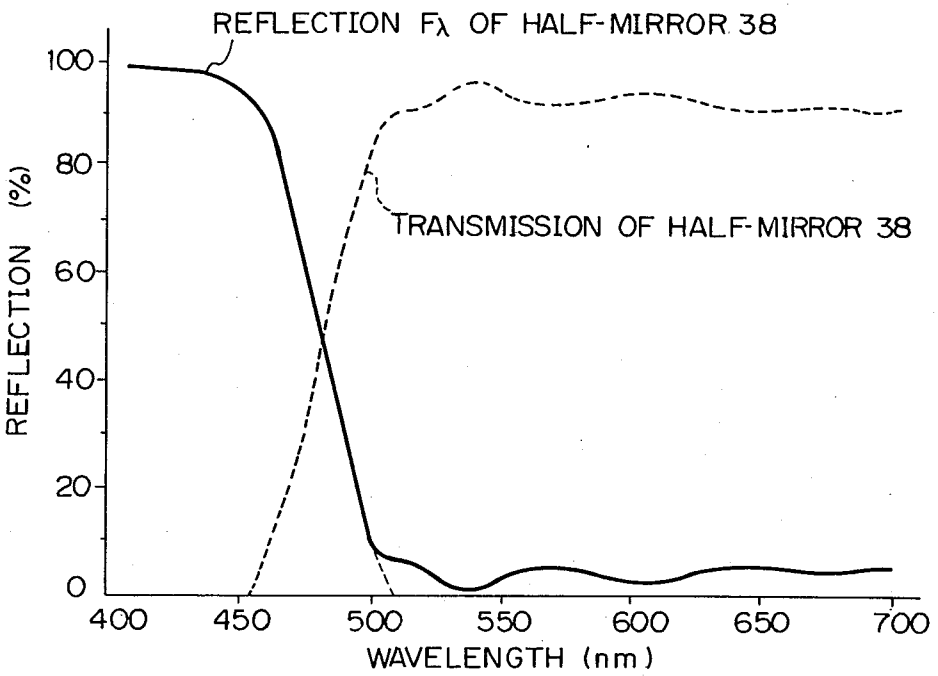
FIG. 9 is a plot showing reflection and transmission characteristics of a half-mirror.
Figure 19:
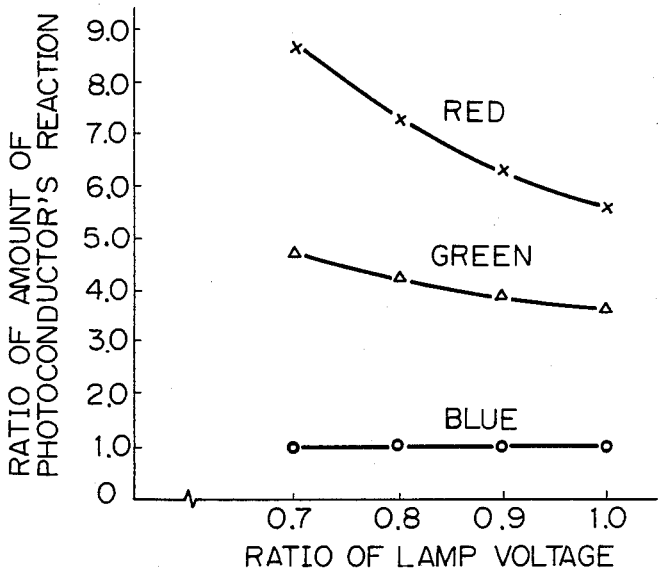
FIG. 19 is a graph showing the amounts of response of a photoconductive element to light of different colors in relation to voltage which is applied to a lamp.

When the voltage applied to the lamp is changed, it in turn changes the color temperature of the lamp and, thereby, the proportions of the amounts of reaction which the photoconductive elements show to the light B, G and R, as shown in FIG. 19. In FIG. 9, when the voltage ratio associated with the lamp is controlled to 0.8, for example, the amounts of reaction mentioned above are brought into the proportions of B:G:R=1.0:4.2:7.3. In this case, as shown in Table 4 by way of example, in order that the total amount of reaction may be equal to that associated with the light B, it is necessary for the transmission of the liquid crystal filters to be changed as shown in Table 8 below.

TABLE 8

| COLOR | ITEM: REACTION RATIO OF ELEMENT | SLIT WIDTH RATIO | LIQUID CRYSTAL TRANSMISSION T | TOTAL REACTION OF ELEMENT E × W × T |
|---|---|---|---|---|
| B | 1.0 | 1.0 | −(100%) | 1.0 |
| G | 4.2 | 0.5 | 73% | 1.0 |
| R | 7.3 | 0.5 | 42% | 1.0 |

Figure 20:
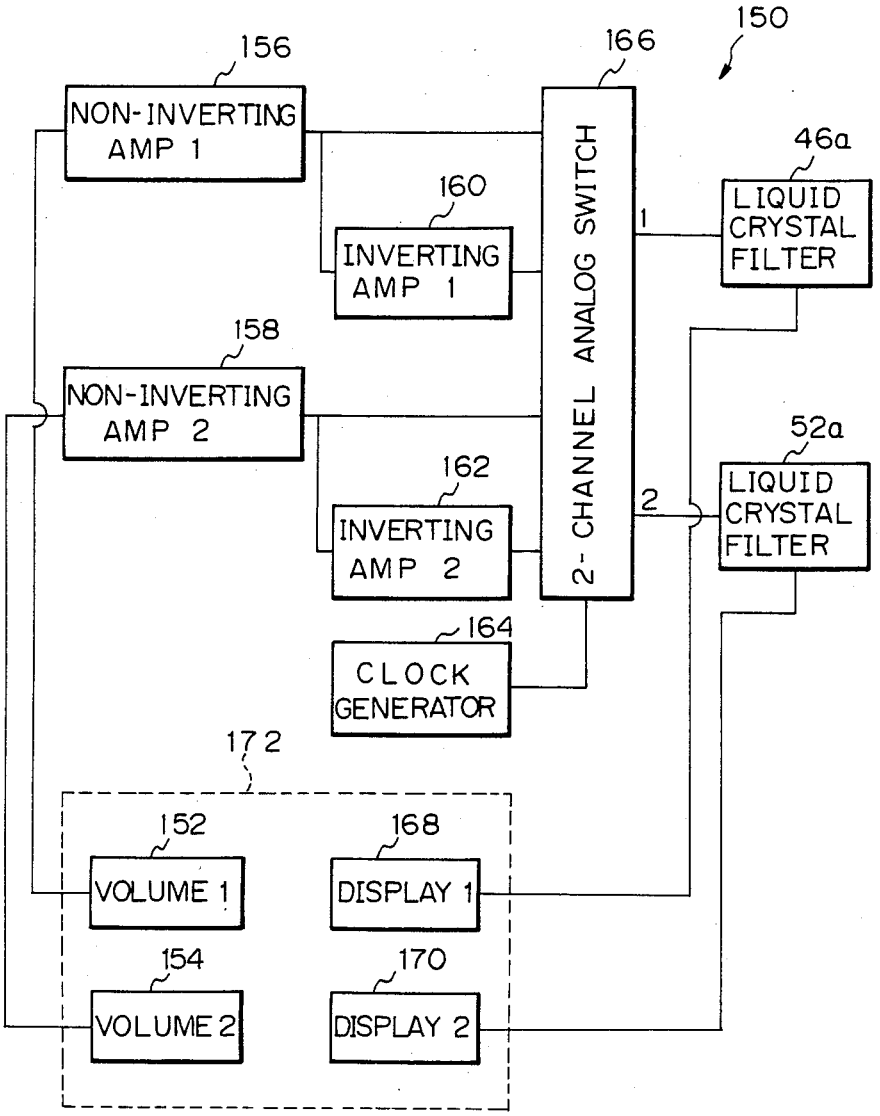
FIG. 20 is a block diagram showing a specific construction of a device for adjusting the amount of light.

Referring to FIG. 20, a light amount control device of the type using liquid crystal filters is shown which is capable of changing the transmission of the filters. The control device, generally 150, comprises volumes 152 and 154 adapted for the adjustment of voltage, non-inverting amplifiers 156 and 158, inverting amplifiers 160 and 162, a clock generator 164, a 2-channel analog switch 166, displays 168 and 170, and an operating section 172 of the device 150 which is provided with the volumes 152 and 154 and the displays 168 and 170, and liquid crystal filters which serve as the ND filters 46*a* and 52*a*.

The liquid crystal filters 46*a* and 52*a* are operated by exactly identical circuits and, therefore, the following description of the operation of the device 150 will concentrate on the filter 46*a* by way of example.

Figure 21:
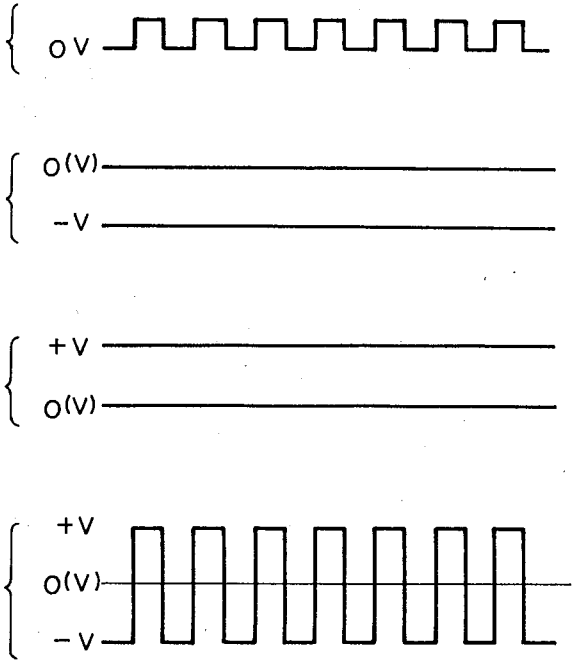
FIGS. 21A, 21B, 21C and 21D are timing charts demonstrating the operation of a liquid crystal filter.

Referring to FIGS. 21A to 21D, the volume 152 is operable to change the mu-factor of the non-inverting amplifier 156 to thereby generate a negative voltage −V (FIG. 21B). The inverter amplifier 160 whose mu-factor is predetermined to be 1 (one) generates a voltage +V (FIG. 21C). In response to the voltages −V and +V, the analog switch 166 converts the output of the clock generator 164 (FIG. 21A) into a bipolar square wave as shown in FIG. 21D. This output of the clock generator 154 operates the filter 46*a*. The output of the filter 46 is also fed to the operating section 172 to allow an operator to manipulate the volume 162 while watching a value appearing on the display 168.

The other liquid crystal filter 52*a* is operated in exactly the same manner as the above-mentioned one.

In this particular embodiment, the balance of the amounts of B, G and R light is controlled by changing the voltage applied to each of the liquid crystal filters 46*a* and 52*a*.

It may be desired to increase or decrease the amount of light G or R only depending upon the kind of a document, in order to enhance good color reproduction. Such is achievable by adjusting only the liquid crystal filter 46*a* or 52*a* which is associated with the desired color component, to a desired degree of transmission.

The above-mentioned uses liquid crystal filters for those filters whose density is continuously variable, and voltage control means for the means for changing the density of the filters. Alternatively, use may be made of a filter produced by providing a neutral filter with a continuous density changing feature (so-called continuous tone filter) and which is moved mechanically, or a filter which is implemented with an electrochromic glass.

Figure 22:
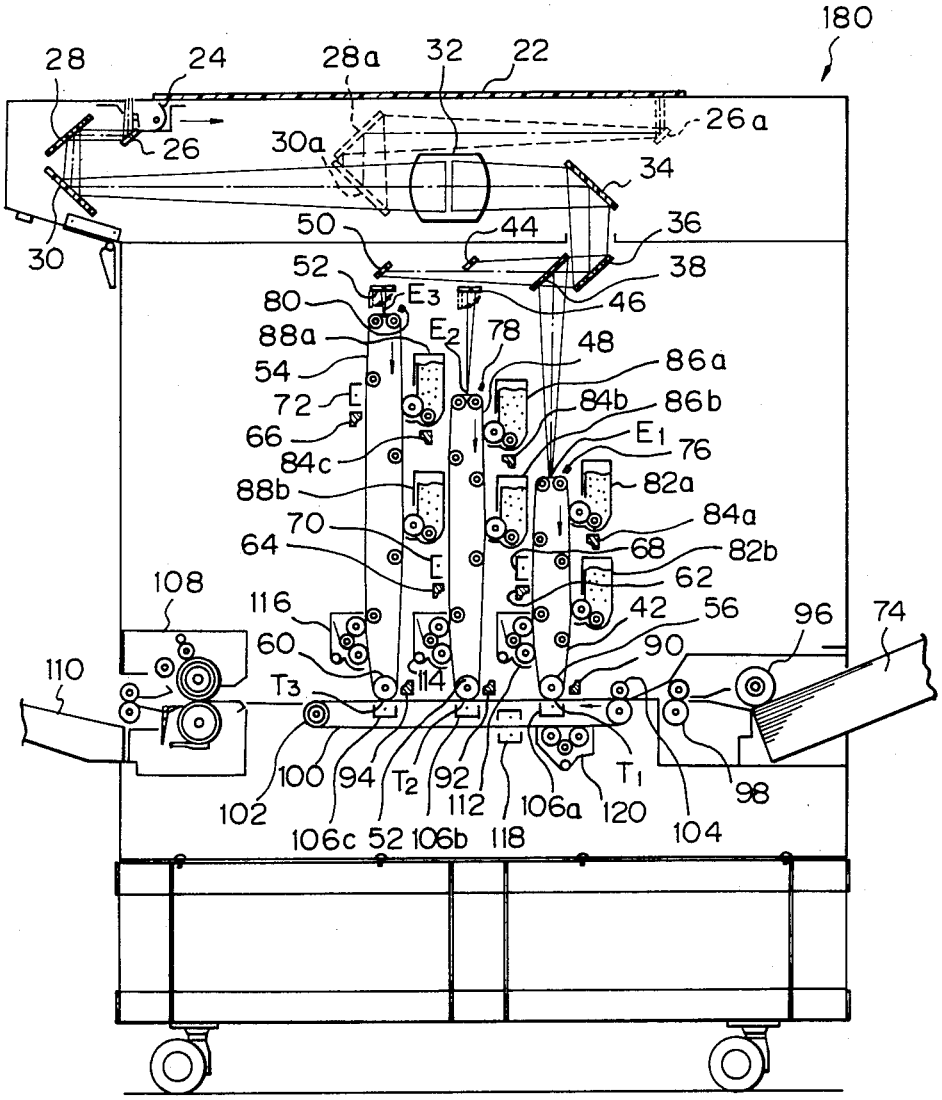
FIG. 22 is a vertical section of a modification to the color copier of FIG. 2.
Figure 23:
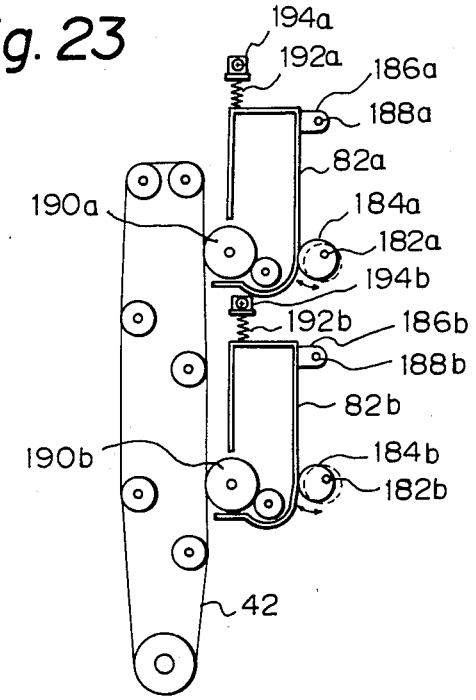
FIG. 23 is an enlarged view of a first photoconductive element and developing units associated therewith which are shown in FIG. 22.
Figure 24:
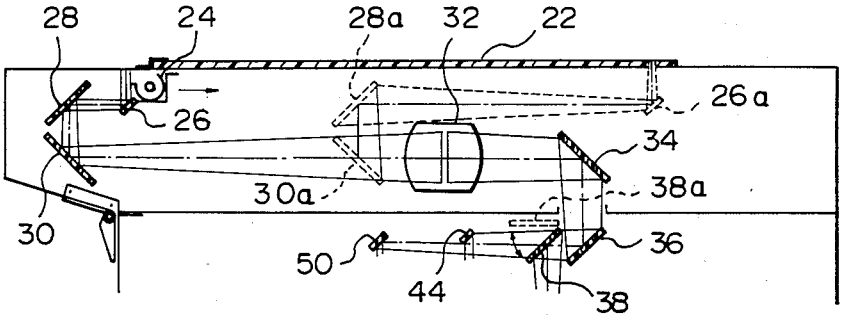
FIG. 24 is a fragmentary view of the copier of FIG. 22.

Referring to FIGS. 22 to 24, there is shown a copier which is a slightly modified version of the color copier of FIG. 2 and capable of selectively effecting a full-color copy mode and a black-white copy mode. In the figures, the same or similar structural elements as those shown in FIG. 2 are designated by like reference numerals.

FIG. 22 shows the overall construction of the copier, generally 180, and FIGS. 23 and 24 show essential parts of the copier 180. The first photoconductive element 42 and its associated developing units will be described first, with particular reference made to FIG. 23. While the developing unit 82*b* stores yellow toner as in the embodiment of FIG. 2, the developing unit 82*a* in this modified arrangement stores black toner. Specifically, the yellow toner developing unit 82*b* is operated in a full-color copy mode, and the black toner developer 82*a* in a black copy mode. The selection of the developing units 82*a* and 82*b* is effected by the selective rotation of an eccentric cam shaft 182*a* or 182*b*. As an eccentric cam 184*a* or 184*b* is rotated as indicated by an arrow in FIG. 23 by the selective rotation of the shaft 182*a* or 182*b*, it rotates its associated developing unit 82*a* or 82*b* about a pin 188*a* or 188*b* which is studded on an arm 186*a* or 186*b*, which in turn extends from the unit 82*a* or 82*b*. As a result, a developing roller 190*a* of the developing unit 82*a* or a developing unit 190*b* of the developing unit 82*b* is brought into contact with the first photoconductive element 42, whereby a latent image provided on the element 42 is developed by the black toner or the yellow toner.

As also shown in FIG. 23, the developing units 82*a* and 82*b* are constantly urged by, respectively, compression springs 192a and 192b against their associated eccentric cams 184a and 184b. Brackets 194a and 194b are provided for anchoring the compression springs 192a and 192b, respectively.

The construction of the developing units described above also applies to the second and third developing units which are associated with the second and third photoconductive elements 48 and 54.

A sequence of image-forming and developing steps in a black-white copy mode will be described.

As regards the first photoconductive element 42, for example, in a full-color copy mode the first photoconductive element 42 is exposed to blue light and, then, the resultant latent image on the element 42 is developed by the developing unit 82b with the yellow toner which is complementary to blue. In a black-white copy mode, on the other hand, the latent image is developed by the developing unit 82a with the black toner. While the selection of the developing unit 82a or 82b is under way as performed by the previously mentioned eccentric cam 182a or 182b, the half mirror 38 is replaced with another or caused to retract to a predetermined position.

In a black-white copy mode, two different situations may occur: (I) one in which development in black is performed with all of the first to third photoconductive elements 42, 48 and 54, and (II) one in which development in black is performed with the second and third photoconductive elements 48 and 54 only. Therefore, the image-forming and developing steps will be described sequentially in relation to those two different situations (I) and (II).

(I) When development in black is to be performed with all of the first to third photoconductive elements 42, 48 and 54, the half-mirror 38 adapted to reflect blue light is replaced with an even half-mirror which reflects about $\frac{1}{3}$ of the whole beam with respect to all of the wavelengths. Simultaneously, the filters 46 and 52 for the separation of different colors are caused to retract to those positions which are indicated by dotted lines in FIG. 22. Further, the eccentric cams 184a and 184b are actuated such that the black toner developing units 82a, 86a and 88a make contact with their associated photoconductive elements 42, 48 and 54 with the color toner developing unit 82b, 86b and 88b positioned clear of the elements 42, 48 and 54. By a discharging exposing procedure, a latent image which is an exact replica of an original image, i.e., which has not been subjected to color separation is formed on each of the photoconductive elements. The latent images are individually developed by the developing units 82a, 86a and 88a and, then, transferred onto papers which are sequentially fed at predetermined timings. Specifically, for the first paper fed, only the transfer charger 106a associated with the first photoconductive element 42 is energized to transfer the black image to the paper; for the second paper, the transfer charger 106b is energized to transfer the black image from the second photoconductive element 48 to the paper; and for the third paper, the transfer charger 106c is energized to transfer the black image from the third photoconductive element 54 to the paper. In this manner, in a black copy mode, three copies are produced at a time by one exposure.

(II) When development in black is to be performed with the second and third photoconductive elements 48 and 54 only, the half-mirror 38 adapted to reflect blue light is moved to its retracted position 38a as shown in FIG. 24, and so are done the filters 46 and 52. In this condition, although images are provided on the second and third photoconductive elements 48 and 54 only, the previously mentioned extra half-mirror for reflecting one third of all of the light is needles, i.e., the transition from a color copy mode to a black-white copy mode can be accomplished simply by shifting the half-mirror 38 and filters 46 to 52 to their retracted positions. In this case, two copies are produced at a time by one exposure by causing the transfer chargers 106b and 106c to operate independently of each other for two papers fed. If desired, both of the developing units 82 and 82b associated with the first photoconductive element 42 may store yellow toner and operated at the same time in a full-color copy mode, in which case the first photoconductive element 42 should naturally be maintained inoperative in a black-white copy mode.

Figure 25:
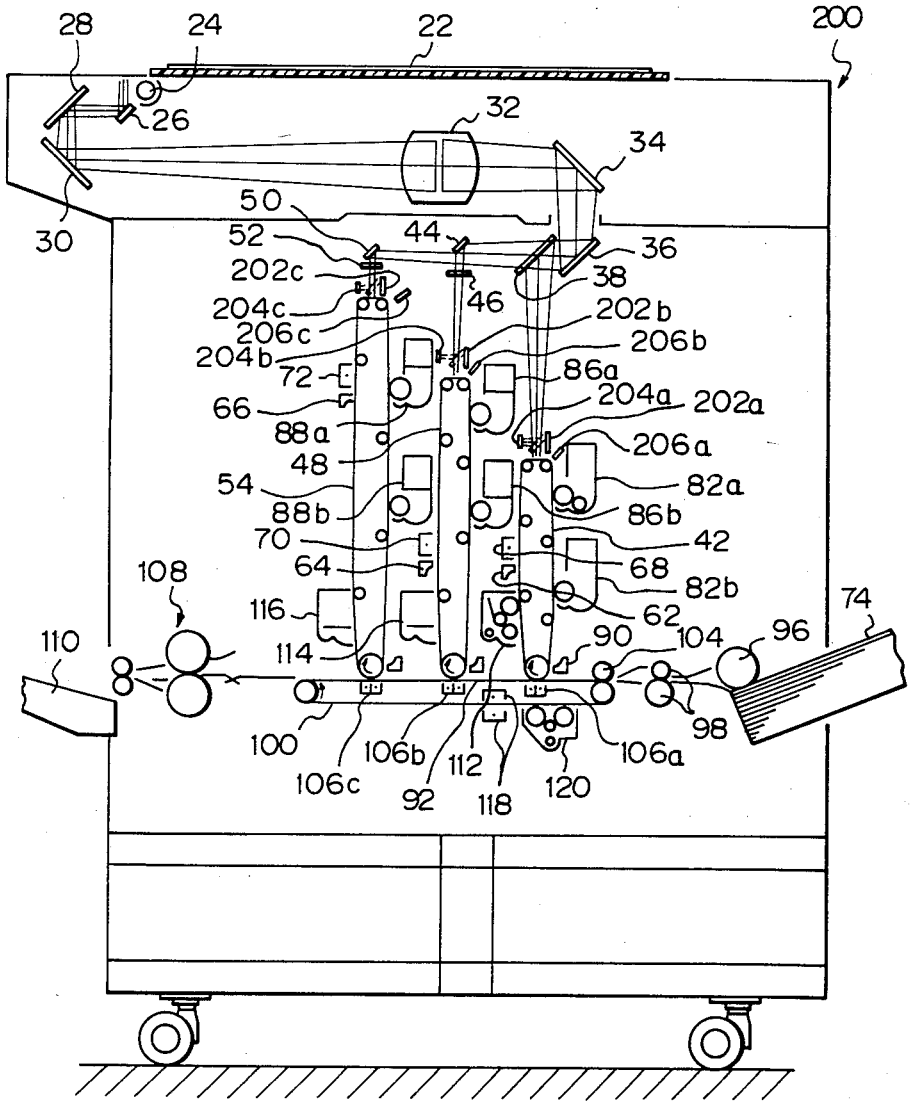
FIG. 25 is a vertical section showing another modification to the copier of FIG. 2.
Figure 26:
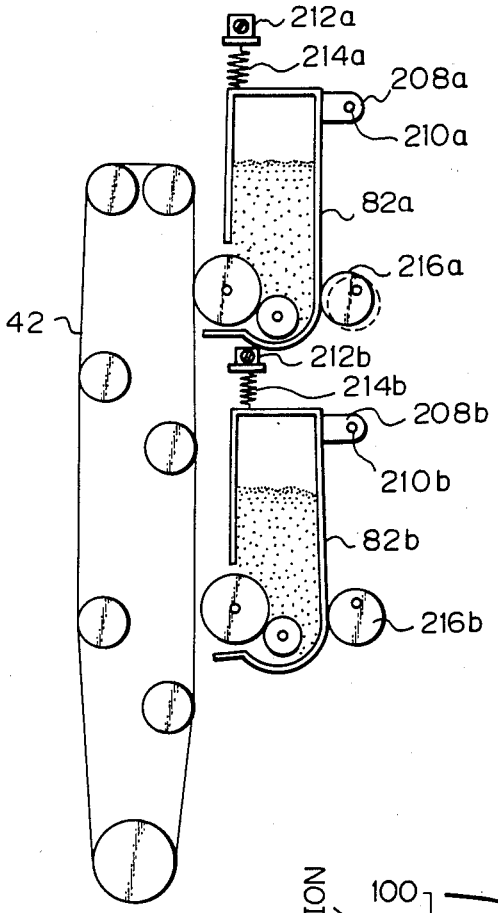
FIG. 26 is a view useful for explaining changeover of an ordinary developing unit and a reverse developing unit which are installed in the copier of FIG. 25.
Figure 27:
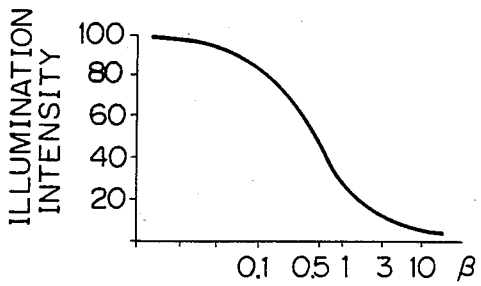
FIG. 27 is a graph showing a relationship between illumination intensity and magnification in the modification of FIG. 25.

Referring to FIGS. 25 to 27, a modification to the color copier of FIG. 2 is shown. This modification includes, in addition to the structural elements of the copier 20 of FIG. 2, three 1-magnification sensors, thee-reflecting members, three dot erasers, and control means. Further, the modified copier is provided with a variable-magnification feature. Each of the three 1-magnification sensors receives a respective one of three beams of different separated colors and photoelectrically converts it. Since those three beams are originally intended to illuminate the respective photoconductive elements, the three reflecting members are used to individually direct the three beams toward the 1-magnification sensors. Hence, each of the three reflecting members may be implemented with a total reflection mirror movable into and out of its associated beam, or a half-mirror. When total reflection mirrors are used for the reflecting members, they are moved into and out of the respective beams in a rotational motion or in a parallel motion such that the light beams become selectively incident to the photoconductive elements and the 1-magnification sensors. On the other hand, when half-mirror are used, they are fixed in place in the split optical paths so as to direct a part of their associated beams toward the photoconductive elments and the rest to the 1-magnification sensors. Needless to mention, when any of the light beams becomes incident to its associated 1-magnification sensor, the former focuses a light image representative of a document on the latter.

The three dot erasers are associated one with each of the photoconductive elements. Each dot eraser is located between the exposing station and the developing station. The dot eraser functions to effect dot erasure on a latent image provided on its associated photoconductive element before the latent image is developed. The dot erasure is adopted not only to erase the charge on the photoconductive element except for an area where an image is formed but also to serve color correction, color balance correction, $\gamma$ correction, erasure of needles image portions, and other various purposes. The dot erase effected by the dot erasers as described is controlled by the control means in response to the outputs of the 1-magnification sensors. Specifically, the control means responsive to the outputs of the 1-magnification sensors performs data processing which is necessary for color correction and others and, based on the result of the processing, controllably drives the dot erasers. The control means may be implemented with a microcomputer, for example.

The modification outlined above will be described in detail with reference to FIGS. 25 to 27. In the figures, the same or similar structural elements as those shown in FIG. 2 are designated by like reference numerals.

As shown in FIG. 2, the color copier, generally 200, includes three rotatable mirrors 202*a*, 202*b* and 202*c* which serve as the reflecting members, 1-magnification sensors 204*a*, 204*b* and 204*c*, and dot erasers 206*a*, 206*b* and 206*c*, in addition to the various structural elements of FIG. 2.

In operation, the mirrors 202*a*, 202*b* and 202*c* are individually so positioned as to direct a light beam incident thereto toward their associated 1-magnification sensors 204*a*, 204*b* and 204*c*, as indicated by dotted lines in FIG. 25. A document to be copied is laid on the glass platen 22 of the copier 200. As the copier 200 starts to operate, the lamp 24 is turned on and moved together with the mirror 26 to the right as viewed in FIG. 25 and at a predetermined velocity V, illuminating the document on the glass platen 22. At the same time, the mirrors 28 and 30 are driven at a velocity of V/2 to the right in FIG. 25. A reflection from the surface of the document is reflected by the mirror 26, then reflected by the mirrors 28 and 30, and then incident to the image-forming lens 32. The light beam transmitted through the lens 32 is sequentially reflected by the mirrors 34 and 36 to become incident to the dichroic filter 38. The dichroic filter 38 serves to reflect blue light and transmits green and red light. Hence, of the light beam, a blue component reflected by the filter 38 is reflected by the mirror 202*a* to be focused onto the 1-magnification sensor 204*a*.

The light beam transmitted through the dichroic filter 38 is split in a slit configuration by the mirror 33. The light beam reflected by the mirror 44 is separated into blue by the filter 46 resulting that a light image representative of a blue separated image of the document is focused onto the 1-magnification sensor 204*b* through the mirror 202*b*. Further, the light beam which is not reflected by the mirror 44 is reflected by the mirror 50, then separated into red by the filter 52, and then focused onto the 1-magnification sensor 204*c* through the mirror 202*c*. Hence, as the 1-magnification sensors 204*a* to 204*c* are driven, the image on the document is read in separate colors, i.e. blue, green and red. The image data produced by the sensors 204*a* to 204*c* are fed to the control means, or microcomputer (not shown), which processes them for color correction, $\gamma$ correction, edge accentuation, and other purposes by any of known suitable methods. When the document is fully read by the above procedure, the mirrors 202*a* to 202*c* are restored to their inoperative positions as indicated by solid lines in FIG. 25. Thereafter, the document is illuminated again so that latent images each corresponding to a respective one of a blue, a green and a red component of color-separated image are formed electrostatically on the respective photoconductive elements 42, 48 and 54.

Each of the dot erasers 206*a* to 206*c* comprises a combination of an LED (light emitting diode) array and a converging light-transmitting element array. When the LEDs are selectively energized in a certain pattern, a 1-magnification image of the pattern is focused onto one of the photoconductive elements which is associated with the dot eraser. If desired, the dot eraser may be implemented with only the LED array which is positioned quite close to the photoconductive element. Controlled by the microcomputer, the dot erasers 206*a* to 206*c* serve the various purposes as previously stated.

The color copier 200 shown in FIG. 25 is further provided with a digital conversion copying capability as will be described.

When a digital conversion copy mode is selected, the mirrors 202*a* to 202*c* are moved to the positions indicated by dotted lines in FIG. 25, and the developing units 82*b*, 86*b* and 88*b* adapted to reverse development are substituted for the developing units 82*a*, 86*a* and 88*a*, respectively. This changeover of the developing units will be described in detail later. The document is illuminated to be read in red, blue and green, as previously described. Each photoconductive element is rotated to be discharged, then cleaned, and then deposited with a uniform electostatic charge. While the 1-magnification sensors 204*a* to 204*c* deliver image data to the microcomputer, the microcomputer drives the dot erasers 206*a* to 206*c* to write the image patterns. Alternatively, the image patterns may be written delayed by a certain period of time relative to image readout by storing the image data in a memory. For example, when a plurality of copies of a single document are desired, latent images for producing the second copy and onward may be provided using data which are stored in a memory. The images are written in the respective photoconductive elements 42, 48 and 54 by illuminating image areas of the latter, so that negative latent images corresponding to the red, green and blue components are formed electrostatically on the photoconductive elements 42, 48 and 54, respectively. These negative images are individually reversely developed by the developing units 82*b*, 86*b* and 88*b* with yellow, magenta an cyan toner. The resultant toner images are transferred onto the paper 74, the fixed, and then driven out onto the tray 110, as is the case with an ordinary copying process. While the polarity adapted for the transfer of the toner images is opposite to the one associated with the previously stated copying process, the steps for cleaning the photoconductive elements after image transfer, discharging them, discharging the transfer belt 100, and cleaning it are the same as those included in the ordinary process.

If desired, $\gamma$ correction, edge accentuation and others may be performed while the dot erasers write image patterns.

The changeover of the developing units will be described with reference to FIG. 26. Since the mechanisms for switching the developing units 82*a* and 82*b*, the developing units 86*a* and 86*b*, the the developing units 88*a* and 88*b* are identical with each other, it will be sufficient to describe the changeover of the developing units 82*a* and 82*b* by way of example.

As shown in FIG. 26, the developing units 82*a* and 82*b* are rotatably supported by, respectively, pins 210*a* and 210*b* through support members 208*a* and 208*b* which are individually rigidly mounted on the casings. The pins 210*a* and 210*b* are individually studded on stationary members. Compression springs 214*a* and 214*b* are loaded, respectively, between the casing of the developing unit 82*a* and a stationary member 212*a* and between the casing of the developing unit 82*b* and a stationary member 212*b*. The developing units 82*a* and 82*b* are, therefore, constantly biased counterclockwise about their associated pins 210*a* and 210*b*. Eccentric cams 216*a* and 216*b* abut against, respectively, the casings of the developing units 82*a* and 82*b* to limit their counterclockwise movement. FIG. 26 shows an ordinary developing condition in which the cam 216*a* urges the developing unit 82*a* to an operative position while, at the same time, the cam 216b maintains the developing unit 82b in an inoperative position.

The changeover of the developing units 82a and 82 for reverse development is effected as follows. The cam 216a is rotated counterclockwise to cause the developing unit 82a to be rotated by the force of the spring 214a, until the unit 82a retracts to its inoperative position. Simultaneously, the cam 216b is rotated clockwise to rotate the developing unit 82b clockwise against the action of the spring 214b, until the unit 82b reachs its operative position. Needless to mention, operating the cams 216a and 216b in the opposite manner will restore the developing units 82a and 82b to the positions shown in FIG. 26.

Such selective operation of the developing units may be implemented with a mode select switch, not shown, which is response to a changeover from an ordinary copying process to a digital copying process or vice versa, and a microcomputer or like controller to which the output of the mode select switch is coupled.

As described above, the color copier 200 furnished with dot erasers and control means for performing data processing and control for the dot erasers is capable of subjecting electrostatic latent images to erasure of needles image portions, color correction, $\gamma$ correction, and other various kinds of correction. Since the illumination of photoconductive elements and the readout of a document are accomplished with the document held unmoved, dot erasing is effected in exact register with the latent images.

As regards variable-magnification feature of the color copier 200, magnification is variable by adjusting the position of an image-forming lens and that of an optical system which is located on the image side with respect to the lens. Since the optical system for illumination serves the reading function at the same, image reading automatically conforms to a change of magnification. As well known in the art, the illumination intensity on the optical axis of the image field of the image-forming lens varies with magnification $\beta$, as shown in FIG. 27. So far as the variable magnification range which is usually discussed in relation to a color copier, i.e., about 0.5 to 2 is concerned, the image illumination intensity and the magnification B may be regarded linearly proportional to each other. Generally, to change magnification, while the moving rate Vp of a photoconductive element is maintained constant, the document scanning rate Vo is varied to satisfy a relation $\beta = Vp/Vo$. As the magnification $\beta$ increases, the illumination intensity on a photoconductive element decreases, as shown in FIG. 27. However, since such causes the document scanning rate Vo to be reduced automatically, the amount of light incident to the photoconductive element or on a 1-magnification sensor is maintained substantially constant with no regard to magnification. Hence, whatever the magnification may be, exposure to imagewise radiation and image reading can be performed under substantially the same conditions.

In summary, the present invention has various unprecedented advantages as enumerated below.

(1) Nothing intervenes between a first half-mirror and a second mirror and between the first half-mirror and a third mirror. This ensures a high optical resolution even if optical images projected onto a plurality of photoconductive elements are the same, compared to a prior art optical system which has two half-mirrors disposed in an optical path which terminates at a particular photoconductive element which is to be exposed last. Hence, clear-cut quality copies in which images of different colors are in accurate register with each other are produced.

(2) The amount of exposing light is variable depending upon the amount of response of any of photoconductive elements, thereby uniformalizing images of respective colors and rationally distributing the entire light from a light source. Such promotes effective use of light issuing from the light source and, thereby, implements a high-speed full-color copier. In addition, the deterioration of images heretofore brought about by the light which is transmitted through distributing mirrors is eliminated to improve image-forming ability.

(3) Light of a particular color to which a photoconductive element shows the smallest amount of reaction can be used to its full extent, enhancing high-speed operations of a color copier.

(4) Since a needless secondary reflection which occurs in a half-mirror is intercepted, it is only the light of a desired color which is allowed to reach the surface of a photoconductive element. Hence, the color separating ability is improved while double exposure is prevented, the resultant image being clear-cut and high quality.

(5) Color separation with a minimum of loss is achieved by use of a dichroic mirror and filters which are implemented with inexpensive triacetate films, contributing a great deal to the production of a high-speed and cost-effective copier.

(6) Filters whose density is continuously variable and means for changing the density of each such filter are disposed on optical paths to which a light image is guided by an image-forming lens and a group of mirrors. This realizes a device which may be installed to allow the transmission of each filter to be changed by simple manipulation.

(7) In the event of splitting light from a light source, the image-forming ability is prevented from being deteriorated despite propagation of the light through a half-mirror. In addition, the light is prevented from being effected by the corners of mirrors and, therefore, efficient use of a light beam is enhanced.

(8) Not only a full-color copy mode is implemented with color toner developing units, but also a black-white copy mode is implemented with black toner developers each being associated with a respective one of photoconductive element units. The operation in a black-white copy mode is sped up because a plurality of black copies can be produced by one exposure by changing a half-mirror or moving it to an inoperative position, moving filters to their inoperative positions, and others.

Various modifications will become possible for those skilled in the art after receiving the teachings of the present disclosure without departing from the scope thereof.

What is claimed is:

1. An optical system for an electronic color copier in which latent images representative of an original document image, which is exposed through a slit, and each corresponding to a respective one of different colors are formed electrostatically one on each of at least a first to a third photoconductive elements, said latent images each being developed by a respective one of toner of a color which is associated with said latent image and, then, transferred to a paper in a superposed position, said optical system comprising:

first optical path splitting means disposed in an optical path, along which incoming image light representative of the document image is propagated, for reflecting a part of said light over an entire width of the slit and transmitting a part of said light;

second optical path splitting means located in a position for intercepting said light which is transmitted through said first optical path splitting means, said second optical path splitting means totally reflecting a part of said light; and third optical path splitting means for totally reflecting a remaining part of the light which is not reflected by said second optical path splitting means;

whereby the light reflected by each of said first to third optical path splitting means is focused onto one of the first to third photoconductive elements which is associated with said optical path splitting means.

2. An optical system as claimed in claim 1, wherein an amount of the light reflected by the first to third optical path splitting means over the entire width of the slit is distributed according to a ratio between amounts of reaction of the photoconductive elements to the different colors.

3. An optical system as claimed in claim 2, wherein the light reflected by the first optical path splitting means is of one of the colors to which the photoconductive elements show a smallest amount of reaction.

4. An optical system as claimed in claim 2, wherein the first optical path splitting means comprises a single half-mirror which reflects light of one color while transmitting light of the other colors, the second and third optical path splitting means each comprising a total reflection mirror which totally reflects the light transmitted through said half-mirror.

5. An optical system as claimed in claim 4, further comprising a filter disposed in an optical path, along which the light reflected by the half-mirror is propagated, for cutting the light of the other colors which are transmitted through said half-mirror.

6. An optical system as claimed in claim 4, further comprising a first to a third color separating filter each being disposed in a respective one of optical paths along which the light reflected by the half-mirror and the second and third optical path splitting means is propagated.

7. An optical system as claimed in claim 6, wherein light having longer wavelengths than a predetermined wavelength range of each of separated colors is cut by using reflection and transmission characteristics of the half-mirror, and light having shorter wavelengths than a predetermined range is cut by using transmission characteristics of the first to third color separating filters.

8. An optical system as claimed in claim 6, further comprising a first to a third neutral density (ND) filter each being disposed in a respective one of said optical paths.

9. An optical system as claimed in claim 8, wherein each of said first to third ND filters comprises a liquid crystal filter transmission of which is variable.

10. An optical system as claimed in claim 9, further comprising means for varying transmission of said liquid crystal filters.

11. An optical system as claimed in claim 10, wherein said transmission varying means comprises means for controlling voltage which is applied to the liquid crystal filters.

12. An optical system as claimed in claim 4, wherein each of the mirrors of the second and third optical path splitting means is provided with a rough back surface, and a light absorbing layer provided on said rough back surface.

13. An optical system as claimed in claim 2, wherein the first to third optical path splitting means comprises a first to a third total reflection mirror each of which is disposed to distribute an optical path according to a ratio between the amounts of reaction of the photoconductive elements.

14. An optical system as claimed in claim 13, wherein said first mirror is positioned remotest from the photoconductive elements in the optical path along which the incoming image light is propagated, said third mirror being positioned nearest to said photoconductive elements, and said second mirror being positioned between said first and third mirrors.

15. An optical system as claimed in claim 14, further comprising a first to a third color separating filter each being disposed in a respective one of optical paths along which the light reflected by the first to third mirrors is propagated.

16. An optical system as claimed in claim 15, wherein light having longer wavelengths than a predetermined wavelength range and associated with each of separated colors is cut by using a reflection characteristic of any of the first to third mirrors, and light having shorter wavelengths than a predetermined range is cut by using a transmission characteristic of any of said first to third filters.

17. An optical system as claimed in claim 15, further comprising a first to a third ND filter each being disposed in a respective one of the optical paths along which the light reflected by the first to third mirrors is propagated.

18. An optical system as claimed in claim 17, wherein each of said ND filters comprises a liquid crystal filter transmission of which is variable.

19. An optical system as claimed in claim 18, further comprising means for varying the transmission of the liquid crystal filters.

20. An optical system as claimed in claim 19, wherein the transmission varying means comprises means for controlling voltage which is applied to the liquid crystal filters.

21. An optical system as claimed in claim 13, wherein each of the first to third mirrors is provided with a rough back surface, and a light absorbing layer provided on said rough surface.

* * * * *